US008666651B2

(12) United States Patent
Kumabe

(10) Patent No.: US 8,666,651 B2
(45) Date of Patent: Mar. 4, 2014

(54) IN-VEHICLE APPARATUS AND OBSTACLE REPORT SYSTEM

(75) Inventor: Seigou Kumabe, Okazaki (JP)

(73) Assignee: DENSO CORPORATION, Kariya (JP)

( * ) Notice: Subject to any disclaimer, the term of this patent is extended or adjusted under 35 U.S.C. 154(b) by 5 days.

(21) Appl. No.: 13/347,889

(22) Filed: Jan. 11, 2012

(65) Prior Publication Data

US 2012/0185160 A1 Jul. 19, 2012

(30) Foreign Application Priority Data

Jan. 14, 2011 (JP) ..... 2011-6098
Dec. 7, 2011 (JP) ..... 2011-268154

(51) Int. Cl.
*G08G 1/16* (2006.01)

(52) U.S. Cl.
USPC ..... 701/301

(58) Field of Classification Search
USPC ..... 701/300–302; 340/901
See application file for complete search history.

(56) References Cited

U.S. PATENT DOCUMENTS

| | | | | |
|---|---|---|---|---|
| 6,223,125 | B1 * | 4/2001 | Hall | 701/301 |
| 6,337,637 | B1 * | 1/2002 | Kubota et al. | 340/901 |
| 7,095,336 | B2 * | 8/2006 | Rodgers et al. | 340/903 |
| 7,375,622 | B2 * | 5/2008 | Takata et al. | 340/436 |
| 7,688,222 | B2 * | 3/2010 | Peddie et al. | 340/905 |
| 7,821,422 | B2 * | 10/2010 | Hutchison et al. | 340/907 |
| 7,859,431 | B2 * | 12/2010 | Peddie et al. | 340/907 |
| 8,362,922 | B2 * | 1/2013 | Kushi et al. | 340/905 |
| 2002/0110261 | A1 * | 8/2002 | Yanai | 382/104 |

FOREIGN PATENT DOCUMENTS

| | | | | |
|---|---|---|---|---|
| JP | A-H8-273098 | | 10/1996 | |
| JP | A-2001-184595 | | 7/2001 | |
| JP | A-2002-150475 | | 5/2002 | |
| JP | 2005125953 | A * | 5/2005 | B60R 21/00 |
| JP | 2006-244295 | A | 9/2006 | |
| JP | A-2007-41931 | | 2/2007 | |
| JP | A-2008-176648 | | 7/2008 | |
| JP | 2011-044063 | A | 3/2011 | |
| JP | 2012-014616 | A | 1/2012 | |

OTHER PUBLICATIONS

Machine Translation of JP 2008-176648 published Jul. 31, 2008.*
Office Action mailed Sep. 24, 2013 issued in corresponding JP patent application No. 2011-268154 (and English translation).

* cited by examiner

*Primary Examiner* — Mary Cheung
*Assistant Examiner* — Anne Mazzara
(74) *Attorney, Agent, or Firm* — Posz Law Group, PLC

(57) ABSTRACT

In a left-hand traffic rule, a subject vehicle turns right at an intersection and then passes over a crosswalk, which is corresponded to by a pedestrian-use traffic signal. When the pedestrian-use traffic signal presents a green color as a currently indicating signal color, an obstacle report range is designated as covering both an area A and an area B so as to report an existence of an obstacle. In contrast, when the pedestrian-use traffic light presents a red color as a currently indicating signal color, an obstacle report range is designated as covering only the area A during a red light elapsed time ranging greater than a first marginal time and less than a time, which is obtained by subtracting a second marginal time from a red light cycle time.

16 Claims, 10 Drawing Sheets

LEFT-HAND TRAFFIC

LEFT-HAND TRAFFIC

IN-VEHICLE APPARATUS AND OBSTACLE REPORT SYSTEM

CROSS REFERENCE TO RELATED APPLICATION

The present application is based on and incorporates herein by reference Japanese Patent Applications No. 2011-6098 filed on Jan. 14, 2011, and No. 2011-268154 filed on Dec. 7, 2011.

FIELD OF THE INVENTION

The present invention relates to an in-vehicle apparatus which reports existence of an obstacle around an intersection to a driver of a vehicle, and an obstacle report system including with the in-vehicle apparatus.

BACKGROUND OF THE INVENTION

[Patent Document 1] JP-A-2008-176648

Patent document 1 recites a system which reports existence of an obstacle at an intersection to a driver of a vehicle. In Patent document 1, a road management apparatus detects a pedestrian located in a crosswalk or in an area adjacent to the crosswalk (also referred to as a crosswalk-adjacent area), and notifies a vehicle turning right or left of pedestrian detection information by a pedestrian-use traffic signal flashing an LED. An in-vehicle apparatus in the vehicle reports the pedestrian detection information to the driver of the vehicle using sounds or images. Thereby, the driver can acquire or recognize the detection information of the pedestrian located in the crosswalk or near the crosswalk.

It is noted that in the technology in Patent document 1, the driver may be notified of an existence of an obstacle whose necessity is not so high; thus, the driver may sense troublesome.

SUMMARY OF THE INVENTION

The present invention is made in view of the above situation. It is an object of the present invention to provide an obstacle report system and an in-vehicle apparatus which help prevent a notification or repot of an existence of an obstacle whose report necessity is low.

To achieve the above object, according to a first example of the present invention, an in-vehicle apparatus is provided as follows. An in-vehicle communicator is included to receive, from the road management apparatus, (i) obstacle existence or nonexistence information, and (ii) traffic signal information, the obstacle existence or nonexistence information indicating an existence of an obstacle that exists in a designated range containing a crosswalk around an intersection, and/or a crosswalk-adjacent area that is adjacent to the crosswalk around the intersection, the traffic signal information containing a currently indicating color of a traffic signal corresponding to the crosswalk. A report processing section is included to execute a report with respect to an obstacle around the intersection to a driver of the vehicle. The report processing section is further configured to suppress a report of an existence of an obstacle that is indicated by the obstacle existence or nonexistence information, which is received via the in-vehicle communicator, based on current traffic signal information received via the in-vehicle communicator.

Thus, whether an obstacle is reported or not is determined based on the traffic signal information; the existence of the obstacle having a low report necessity can be thus suppressed from being reported.

According to another example of the present invention, an obstacle report system is provided as follows. The obstacle report system includes a road management apparatus provided for an intersection, and an in-vehicle apparatus mounted in a vehicle to receive information transmitted from the road management apparatus. The road management apparatus includes an obstacle detection section, a traffic signal information acquisition section, and a transmission section. The obstacle detection section is to detect an obstacle in a designated range containing (i) a crosswalk around an intersection, and/or (ii) a crosswalk-adjacent area that is adjacent to the crosswalk around the intersection. The traffic signal information acquisition section is to acquire traffic signal information containing a currently indicating signal color of a traffic signal corresponding to the crosswalk. The transmission section is to transmit (i) obstacle existence or nonexistence information that indicates an existence of an obstacle detected by the obstacle detection section and (ii) traffic signal information acquired by the traffic signal information acquisition section. The in-vehicle apparatus includes an in-vehicle communicator and a report processing section. The in-vehicle communicator is to receive (i) obstacle existence or nonexistence information, which is received from the obstacle detection section via the transmission section of the road management apparatus, and (ii) traffic signal information, which is received from the traffic signal information acquisition section via the transmission section of the road management apparatus. The report processing section is to execute a report of an obstacle indicated in the obstacle existence or nonexistence information, which is received from the obstacle detection section via the in-vehicle communicator, to a driver of the vehicle. Further, the report processing section is configured to suppress the report of the obstacle based on current traffic signal information received from the traffic signal information via the in-vehicle communicator.

Like in the above configuration of the in-vehicle apparatus, whether an obstacle is reported or not is determined based on the traffic signal information; thus, the existence of the obstacle having a low report necessity can be suppressed from being reported.

BRIEF DESCRIPTION OF THE DRAWINGS

The above and other objects, features, and advantages of the present invention will become more apparent from the following detailed description made with reference to the accompanying drawings. In the drawings.

DETAILED DESCRIPTION OF THE PREFERRED EMBODIMENTS

First Embodiment

The following will explain an obstacle detection system and an in-vehicle apparatus according to a first embodiment of the present invention with reference to FIG. 1 to FIG. 8. It is noted that in the first embodiment, the obstacle detection system is achieved as an obstacle report system 1. That is, a subject vehicle C is designated as satisfying an assistance condition that will be explained later. The obstacle report system reports an existence of an obstacle that is located in/on a crosswalk Z or an area adjacent to the crosswalk Z (also referred to as a crosswalk-adjacent area) which the subject vehicle C passes through after turning right in a left-hand traffic rule.

Figure 1:
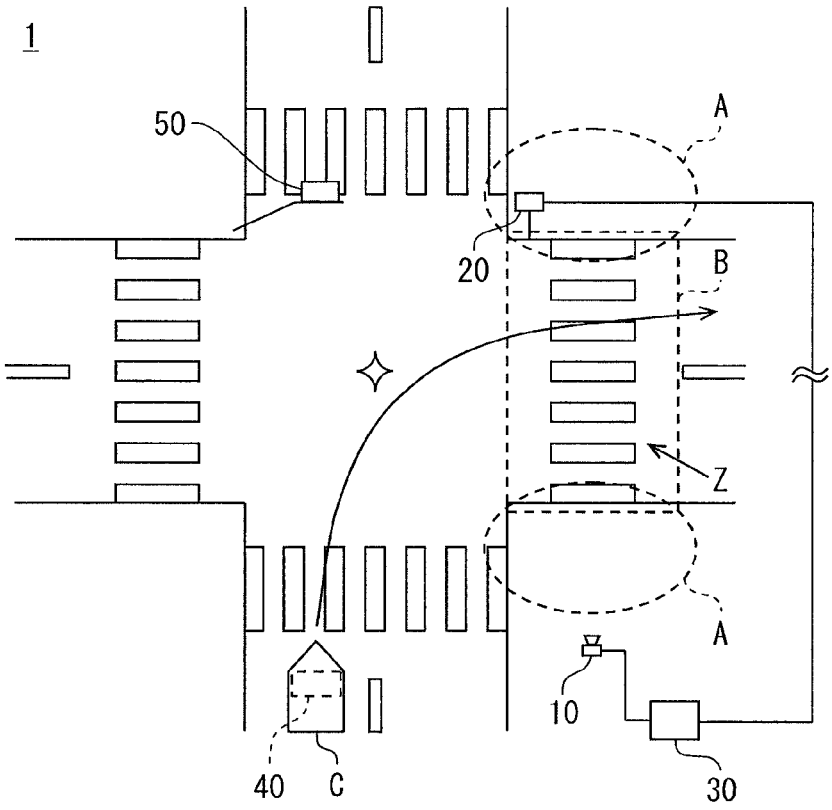
FIG. 1 is a schematic diagram of an overall configuration containing an intersection in an obstacle report system according to a first embodiment of the present invention.

With reference to FIG. 1 to FIG. 6, the obstacle report system 1 and the in-vehicle apparatus 40 will be explained in respect of a configuration and a function. As illustrated in FIG. 1, the obstacle report system 1 includes a road management apparatus 30 installed for an intersection with traffic signals and an in-vehicle apparatus 40 mounted in the subject vehicle C. Naturally, the subject vehicle C is only a single example. A plurality of vehicles C and a plurality of in-vehicle apparatuses 40 can be included in this obstacle report system 1. The road management apparatus 30 (also referred to as a roadside apparatus 30) is connected with (i) a road detection sensor 10 to detect a pedestrian and (ii) a pedestrian-use traffic signal 20 corresponding to the crosswalk Z.

With reference to FIG. 1, the road detection sensor 10 is to detect an obstacle in a detection range that contains an area A and an area B. The area A is an area adjacent to the crosswalk Z and indicated by an elliptical broken line; thus, the area A may be referred to as a crosswalk-adjacent area A. In detail, the area A is adjacent to each end of the crosswalk Z in the walking direction. The area B is surrounding the crosswalk Z of a rectangle indicated by a broken line, sandwiched by the two areas A adjacent to both ends of the crosswalk Z in the walking direction. This road detection sensor outputs successively sensor information which indicates whether the obstacle exists or not to the road management apparatus 30. This road detection sensor 10 may use a camera which captures or covers the above detection range as an image capture range, for example. When using the camera, the road detection sensor 10 outputs successively, as the sensor information, information on images which are captured within the image capture range to the road management apparatus 30. The sensor information processing section 321 specifically determines a position of an obstacle as explained later. Although the area A is designated so as to contain a part of the crosswalk Z according to the first embodiment, there is no need to be limited thereto. The area A only needs to be designated so as to capture a pedestrian who is waiting at a pedestrian-use traffic signal 20 near the crosswalk Z. In addition, although the area B is designated so as to contain a periphery (in a right and left direction in FIG. 1) of the crosswalk Z as well as the an area just on the crosswalk Z according to the present embodiment, there is no need to be limited thereto. The area B only needs to be designated so as to capture a pedestrian who walks in/on or passes through the crosswalk Z to thereby pass across the road.

Figure 2:
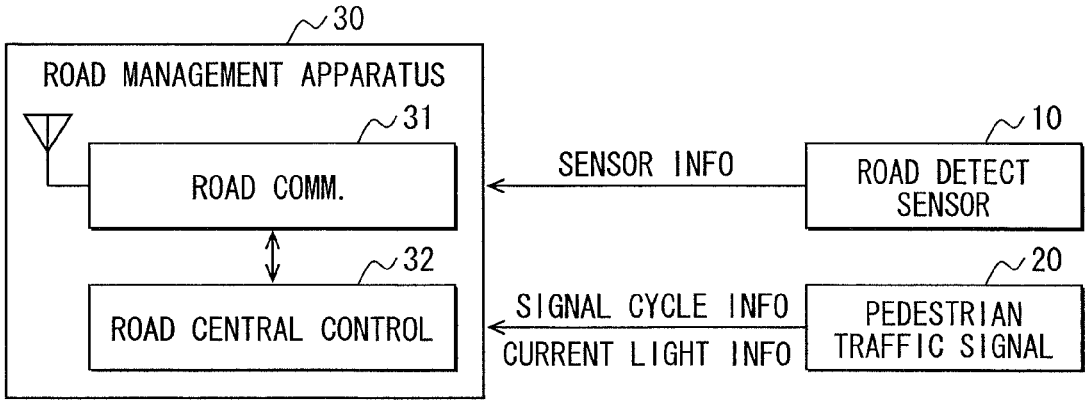
FIG. 2 is a block diagram illustrating a configuration of a road management apparatus according to the first embodiment.

The pedestrian-use traffic signal 20 is a well-known one; it is lighting constantly or flashing a permission color ("green" color in the present embodiment), which indicates that the crosswalk Z is in a passing permission state, or is lighting constantly a prohibition color ("red" color in the present embodiment), which indicates that the crosswalk Z is in a passing prohibition state. In detail, the pedestrian-use traffic signal 20 has a signal cycle (also referred to as a signal switchover cycle) between a green constant lighting state, a green flashing state, and a red constant lighting state. That is, the signal switchover cycle provides the green constant lighting state (35 "seconds")→the green flashing state (15 "seconds")→the red constant lighting (60 "seconds"). Further, as indicated in FIG. 2, the pedestrian-use traffic signal 20 outputs the signal cycle information that includes duration of the green constant lighting state, green flashing state, red constant lighting state, and information on the order of the foregoing states to the road management apparatus 30. The pedestrian-use traffic signal 20 outputs successively the currently indicating signal color information (also referred to as current light color information) that is information indicating a signal color that is currently indicated or presented, to the road management apparatus 30. In the present embodiment, this currently indicating signal color information may be also referred to as traffic signal information or current traffic signal information.

In FIG. 1, the above road detection sensor 10 and the pedestrian-use traffic signal 20 are indicated or assigned only to the single crosswalk Z out of the four crosswalks which exist around or for the identical intersection. This is only because the other graphics are omitted from the explanation for simplification. Actually, the set of the road detection sensor 10 and the pedestrian-use traffic signal 20 are provided to each of all the crosswalks provided for the intersection. The road detection sensor 10 and pedestrian-use traffic signal 20 transmit the above-mentioned sensor information, signal cycle information, and currently indicating signal color information to the road management apparatus 30 while adding an ID of the road where they are installed. It is noted that different road IDs are assigned to entrance roads and exit roads, respectively, with respect to the intersection. Further, the IDs are assigned in a predetermined fixed rule such as a clockwise rotation order or a counterclockwise rotation order. For instance, the predetermined fixed rule is to change IDs by incrementing one (1).

In addition, the vehicle-use traffic signal 50 is also actually illustrated to only one in FIG. 1; however, it is provided to each of all the roads that enter the intersection. The vehicle-use traffic signal 50 also transmits the currently indicating signal color information and signal cycle information to the road management apparatus 30 by adding an ID.

The road management apparatus 30 includes a road communicator 31 and a road central controller 32 as illustrated in FIG. 2. The road communicator 31 has a well-known antenna to execute a wireless communication with an in-vehicle apparatus 40. This road communicator 31 may function as a transmission device or means. The road central controller 32 is a computer containing a well-known CPU and internal memory. The CPU realizes the various functions by executing programs previously stored in the internal memory. The road central controller 32 has functions as a sensor information processing section 321, a signal cycle information acquisition section 322, a current light information acquisition section 323 (also referred to as a currently indicating signal color information acquisition section), a timer section 324, a transmission information determination section 325, and a transmission processing section 326. Further, the sensor information processing section 321 may function as an obstacle detection section, device, or means. The current light information acquisition section 323 may function as a traffic signal information acquisition section, device, or means.

The sensor information processing section 321 acquires sensor information from the road detection sensor 10 successively; the sensor information acquired successively is processed. An obstacle is thereby detected in a detection range including the areas A and B. Further, it is determined whether the obstacle exists in the area A or the area B. It is noted that the present embodiment is premised that an obstacle is an object which may collide with the subject vehicle C that is traveling a road. The obstacle includes a moving object and a temporarily stopping object, but does not include an unmoved object that is fixedly stationary. Therefore, neither the pedestrian-use traffic signal 20 nor a telegraph pole (unshown) is defined as an obstacle. In contrast, the obstacle includes a movable object such as a pedestrian who is passing across a road using a crosswalk Z or stops temporarily for waiting at a red light. The sensor information processing section 321 determines a position of an identical object based on the sensor information successively acquired from the road detection sensor 10, thereby distinguishing the above obstacle and the fixed object from each other.

In addition, the sensor information processing section 321 is connected to the transmission processing section 326, and outputs obstacle existence or nonexistence information which indicates whether an obstacle exists in the area A or the area B to the transmission processing section 326. The obstacle existence or nonexistence information includes the information which indicates whether an obstacle exists and, further, detection area information which indicates a position where an obstacle is located when the obstacle is detected.

The signal cycle information acquisition section 322 is connected to the transmission information determination section 325 to acquire the signal cycle information outputted from the pedestrian-use traffic signal 20 and output the acquired signal cycle information to the transmission information determination section 325.

The current light information acquisition section 323 is connected with the timer section 324 and the transmission information determination section 325, to thereby acquire successively the current light information from the pedestrian-use traffic signal 20 and output successively the acquired currently indicating signal color information to the timer section 324 and the transmission information determination section 325. In addition, the current light information acquisition section 323 acquires currently indicating signal color information (hereinafter referred to as currently indicating vehicle-use signal color information) successively from the vehicle-use traffic signal 50. The currently indicating signal color information acquisition section 323 outputs successively this currently indicating vehicle-use signal color information to the transmission processing section 326. It is noted that when currently indicating signal color information is indicated, it signifies the currently indicating signal color information of the pedestrian-use traffic signal 20, instead of the vehicle-use traffic signal 50.

The timer section 324 is connected to the currently indicating signal color information acquisition section 323 to thereby measure the red light elapsed time t1 using a counter as needed based on the currently indicating signal color information inputted successively. The above red light elapsed time t1 starts from a base time when the pedestrian-use traffic signal 20 switches from the green flashing state (green flash) into the red constant lighting state. In addition, the timer section 324 is connected to the transmission information determination section 325. When having measured a red light elapsed time t1, the time section 324 transmits the red light elapsed time t1 successively to the transmission information determination section 325. It is noted that the red light elapsed time t1 is reset when the pedestrian-use traffic signal 20 changes from the red constant lighting state into the green constant lighting state as the following signal cycle state.

The transmission information determination section 325 is connected to each of the signal cycle information acquisition section 322, the currently indicating signal color information acquisition section 323, and the timer section 324, to receive the signal cycle information, the currently indicating signal color information, and the red light elapsed time t1, respectively.

Figure 4:
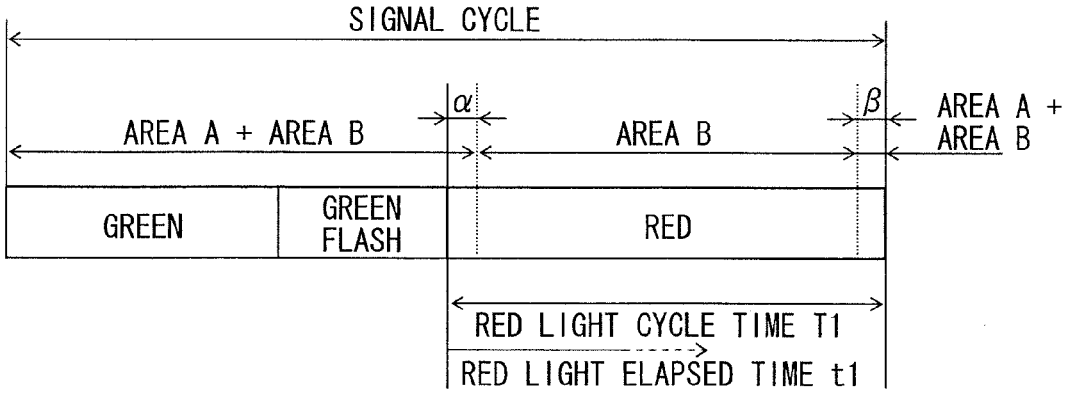
FIG. 4 is a diagram illustrating a time-based sequence or relation of a signal cycle, a report range, a red time cycle time, and a red light elapsed time.

This transmission information determination section 325 determines a transmission-needed existence area of an obstacle (also referred to as an obstacle transmission area) based on the currently indicating signal color information acquired by the currently indicating signal color information acquisition section 323. In detail, the transmission information determination section 325 determines the area A+area B as an obstacle transmission area, as illustrated in FIG. 4, in cases that the pedestrian-use traffic signal 20 presents the green constant lighting state or the green flashing state (green flash). In addition, the area B is determined as an obstacle transmission area primarily in cases that the pedestrian-use traffic signal 20 presents the red constant lighting state.

It is noted that in the present embodiment, even when it is determined that the pedestrian-use traffic signal 20 presents the red constant lighting state, there is a case that an area covering both the area A and area B is determined as an obstacle transmission area. More specifically, the transmission information determination section 325 determines the area A+area B as an obstacle transmission area before the red light elapsed time t1 reaches a first marginal time α (e.g., 60 seconds) that is shorter than a red light cycle time T1 (also referred to as a red light duration time T1).

In other words, the transmission information determination section 325 further maintains the same obstacle transmission area as that in cases where the pedestrian-use traffic signal 20 presents the green lighting state by the first marginal time α. This first marginal time α may be a fixed time shorter than the red light cycle time T1 or a variable time which may become longer as the number of obstacles that are still passing through the crosswalk Z becomes greater even if the currently indicating signal color is switched into the red.

In addition, the transmission information determination section 325 determines the area B as an obstacle transmission area from when the red light elapsed time t1 reaches the above marginal time α to when the red light elapsed time t1 reaches a time shorter than the red light cycle time T1 by a second marginal time β. Thereafter, the total of the area A and area B (i.e., an area covering both the areas A, B) is determined as an obstacle transmission area. In other words, the transmit information determination section 325 switches the obstacle transmission area into the same area as that in the case where the pedestrian-use traffic signal 20 presents the green lighting state earlier by the second marginal time β. The second marginal time β may be a fixed time shorter than the red light cycle time T1 or a variable time which may become longer as the number of obstacles that start to pass through the crosswalk Z becomes greater even though the currently indicating signal color is not switched into the green lighting state.

The transmission information determination section 325 is connected to the transmission processing section 326, and outputs the information indicating the above determined obstacle transmission area to the transmission processing section 326. It is noted that the sensor information processing section 321, the signal cycle information acquisition section 322, the currently indicating signal color information acquisition section 323, the timer section 324, and the transmission information determination section 325 process data using the information from the road detection sensor 10, the pedestrian-use traffic signal 20 corresponding with respect to each of all the crosswalks.

The transmission processing section 326 is connected with the sensor information processing section 321 and the transmission information determination section 325, and transmits the obstacle existence or nonexistence information in order to report an existence of an obstacle to the in-vehicle apparatus 40 based on the obstacle existence or nonexistence information outputted from the sensor information processing section 321, and the obstacle transmission area outputted from the transmission information determination section 325.

More specifically, suppose the case where the area A+area B is determined as an obstacle transmission area, and an obstacle is detected in the area A or area. B. In this case, the transmission processing section 326 transmits the obstacle existence or nonexistence information which indicates that the obstacle is detected in the area A or the area B to the in-vehicle apparatus 40 using the road communicator 31. In addition, suppose the case where the area B is determined as an obstacle transmission area, and an obstacle is detected in the area B. In this case, the transmission processing section 326 transmits the obstacle existence or nonexistence information which indicates that the obstacle is detected in the area B to the in-vehicle apparatus 40 using the road communicator 31. The transmitted obstacle existence or nonexistence information contains obstacle existence or nonexistence information on the area A and/or area B corresponding to each crosswalk existing around the intersection to thereby distinguish one of the crosswalks using the road ID identifying a crosswalk.

In addition, the transmission processing section 326 also transmits successively the currently indicating vehicle-use signal color information. Also this currently indicating vehicle-use signal color information presents the road ID, to thereby distinguish the corresponding road.

Figure 5:
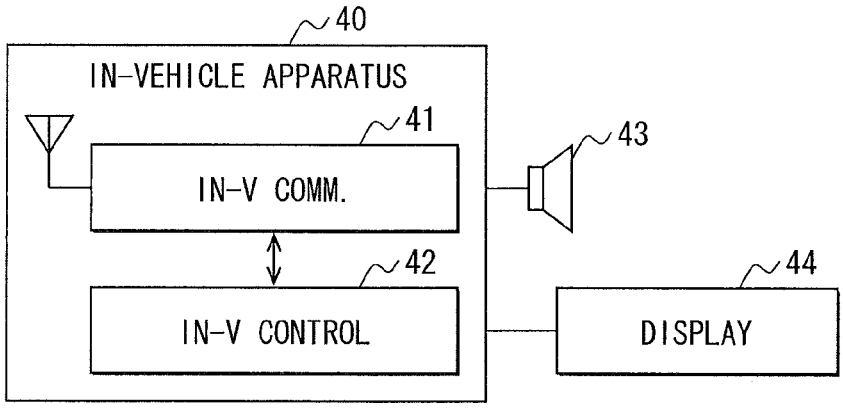
FIG. 5 is a block diagram illustrating a configuration of an in-vehicle apparatus in the obstacle report system according to the first embodiment.

The following will explain a configuration of the in-vehicle apparatus 40. The in-vehicle apparatus 40 includes an in-vehicle communicator 41 and an in-vehicle controller 42 as illustrated in FIG. 5. In addition, this in-vehicle apparatus 40 is equipped with a well-known speaker 43 and a display 44 as a notification device or means.

The in-vehicle communicator 41 has a well-known antenna to execute a wireless communication with the road management apparatus 30. The in-vehicle controller 42 is a computer containing a well-known CPU and internal memory. The CPU realizes the various functions by executing programs previously stored in the internal memory.

Figure 6A:
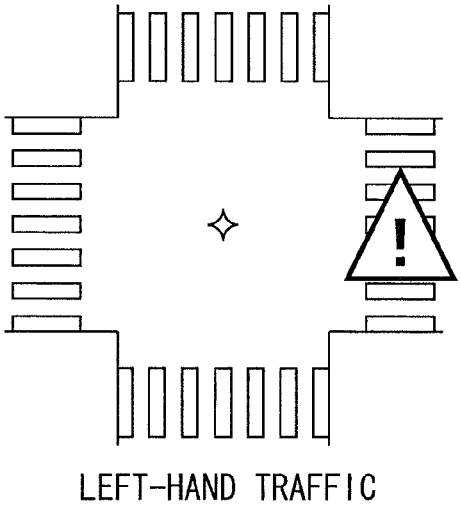
FIG. 6A is a diagram illustrating an example of a report mode on a display of the in-vehicle apparatus when a pedestrian is detected in area B in cases that a report range is designated as covering only the area B.

When receiving the obstacle existence or nonexistence information which indicates that an obstacle is detected in the area B via the in-vehicle communicator 41, the in-vehicle controller 42 outputs a notice sound speech, such as "a pedestrian is existing" via a speaker 43, and displays a notice image indicating a graphic to prompt the driver's attention on the crosswalk on a display region of the display 44, for instance, with reference to FIG. 6A.

Figure 6B:
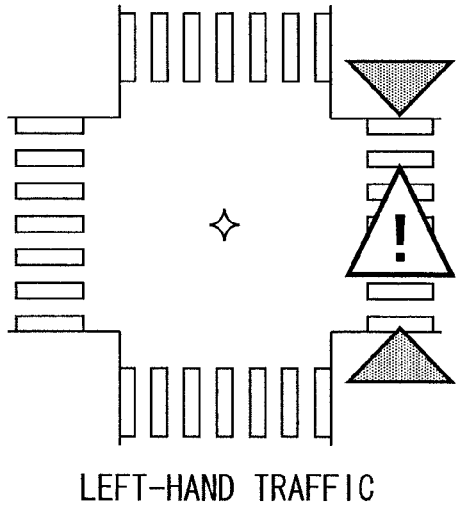
FIG. 6B is a diagram illustrating an example of a report mode on a display of the in-vehicle apparatus when a pedestrian is detected in area A or area B in cases that a report range is designated as covering both the area A and the area B.

In addition, when receiving the obstacle existence or nonexistence information which indicates that an obstacle is detected in the area A or the area B via the in-vehicle communicator 41, the in-vehicle controller 42 outputs a notice sound speech, such as "please pay attention to a pedestrian" via the speaker 43, and displays a notice image indicating a graphic to prompt the driver's attention on the crosswalk and a graphic to suggest an existence of an obstacle existing a crosswall-adjacent area on a display region of the display 44, for instance, with reference to FIG. 6B.

Figure 8:
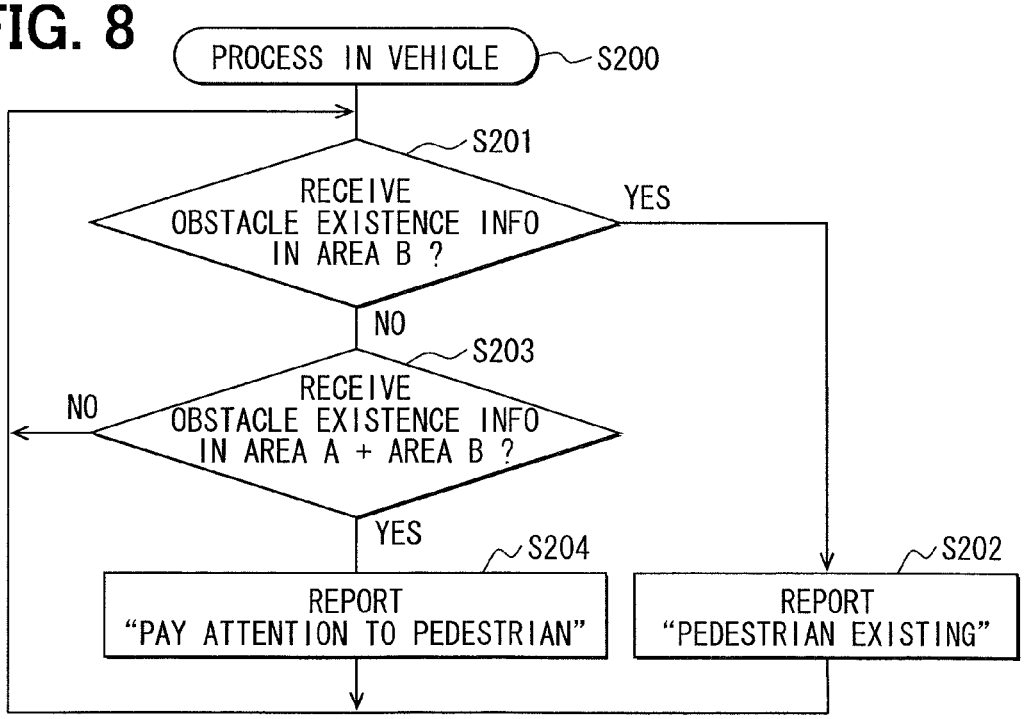
FIG. 8 is a flowchart diagram illustrating an example of a process executed by an in-vehicle apparatus according to the first embodiment.

Further, the obstacle existence or nonexistence information on the area A and/or area B corresponding to each crosswalk existing around the intersection are acquired from the road management apparatus 30. Therefore, the in-vehicle controller 42 needs to determine which crosswalk's obstacle existence or nonexistence information is necessary for the subject vehicle. Such determination is made using a road ID of the road which the subject vehicle C is running, and the road ID attached to the obstacle existence or nonexistence information. FIG. 8 explains the details of the determination method.

Figure 7:
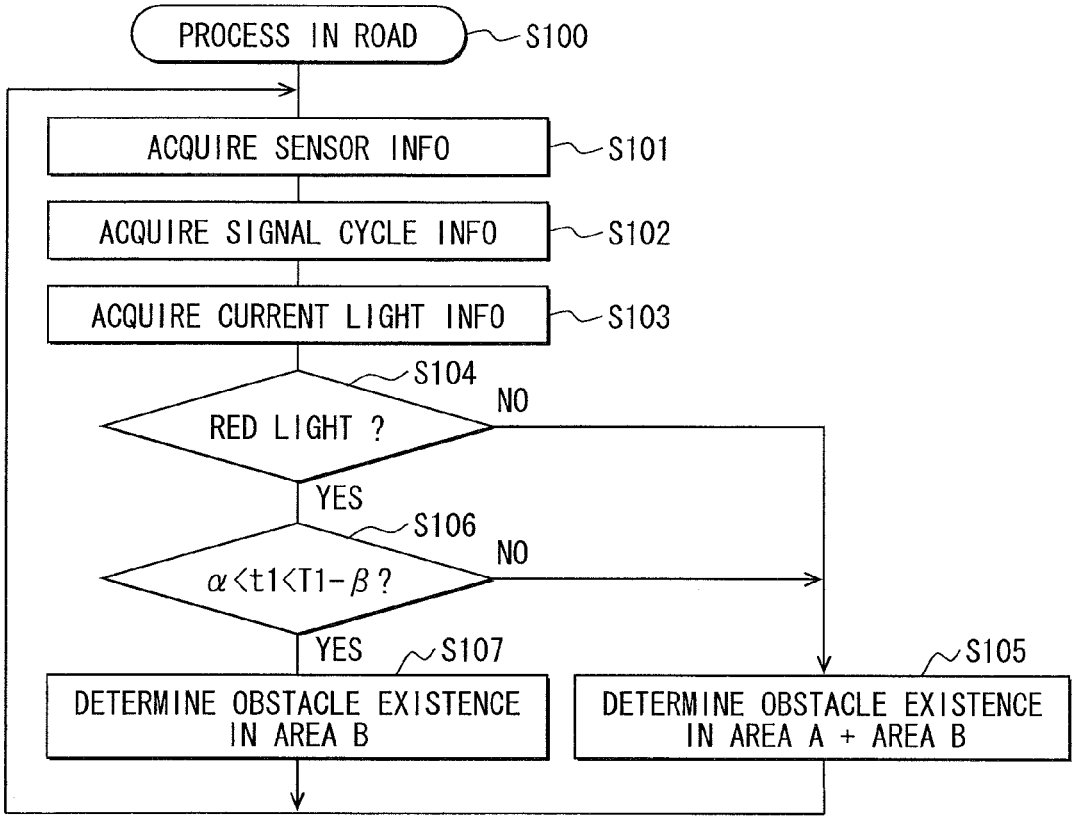
FIG. 7 is a flowchart diagram illustrating an example of a process executed by a road management apparatus according to the first embodiment.

The following will explain a process S100 by the road management apparatus and a process S200 by the in-vehicle apparatus 40 with reference to FIG. 7 and FIG. 8, respectively.

It is further noted that a flowchart or the processing of the flowchart in the present application includes sections (also referred to as steps), which are represented, for instance, as S101. Further, each section can be divided into several subsections while several sections can be combined into a single section. Furthermore, each of thus configured sections can be referred to as a device, means, module, or processor and achieved not only as a software section in combination with a hardware device but also as a hardware section. Furthermore, the software section may be included in a software program, which may be contained in a non-transitory computer-readable storage media as a program product.

First, the process S100 by the road management apparatus 30 is explained with reference to FIG. 7. The road management apparatus 30 always executes the process S100 continuously. As the process S100 is started, sensor information is acquired from the road detection sensor 10 at S101. At S102, S103, signal cycle information and currently indicating signal color information are acquired from the pedestrian-use traffic signal 20.

At S104 after acquiring the varieties of information, the road management apparatus 30 determines whether the currently indicating signal color is red. When it is determined that the currently indicating signal color is not red (namely, currently indicating signal color green) (S104: No), the road management apparatus 30 determines and transmits the obstacle existence or nonexistence information in the area A+area B at S105. In detail, the road management apparatus 30 determines a report range (also referred to as a designated range) as covering both the area A and area B, and detects an obstacle in the area A or the area B based on the sensor information acquired at previous S101, then transmitting the detection result (namely, the obstacle existence or nonexistence information).

In contrast, when it is determined that the currently indicating signal color is red (S104: Yes), the road management apparatus 30 executes a determination at S106, where it is determined whether the red light elapsed time t1 is greater than the first marginal time $\alpha$ and less than a time period that is obtained by subtracting the second marginal time $\beta$ from the red light cycle time T1.

When it is determined that the red light elapsed time t1 is less than the first marginal time $\alpha$ or greater than the time period that is obtained by subtracting the second marginal time $\beta$ from the red light cycle time T1 (S106: No), the road management apparatus 30 advances to S105.

In contrast, it is determined that the red light elapsed time t1 is greater than the first marginal time $\alpha$ and less than the time period that is obtained by subtracting the second marginal time $\beta$ from the red light cycle time T1 (S106: Yes), the road management apparatus 30 transmits the obstacle existence or nonexistence information in the area B at S107. In detail, the road management apparatus 30 determines the area B as a report range, and detects an obstacle in the area B based on the sensor information acquired at previous S101, then transmitting the detection result (namely, the obstacle existence or nonexistence information). When this S107 is executed, any existence of an obstacle which exists in the area A is not reported. That is, in the present embodiment, suppressing the report is made by not executing any report.

When S105 or S107 is executed, the road management apparatus 30 returns to S101. It is noted that the road management apparatus 30 transmits successively the currently indicating vehicle-use signal color information apart from the process indicated in FIG. 7.

Next, the process S200 by the in-vehicle apparatus 40 is explained with reference to FIG. 8. This process S200 executed by the in-vehicle controller 42 may function as a report processing section, device, or means. The in-vehicle controller 42 starts the process S200 when the assistance condition is satisfied. The assistance condition is satisfied when the following three conditions are satisfied at the same time. (1) The vehicle C is in the assistance service area, (2) The right blinker is set to ON in the left-hand traffic rule, and (3) The currently indicating signal color of the vehicle-use traffic signal 50 in the heading direction of the subject vehicle is a color which indicates a passing permission. When at least one of the above conditions (1)-(3) is not satisfied, the process of FIG. 8 is not executed. Therefore, when at least one of the conditions (1)-(3) is not satisfied, the existence of an obstacle around the intersection is not reported.

The determination of the condition (3) is made affirmatively when the currently indicating lighting color of a lighting signal presents a traffic permission state (e.g., a green color). In addition, in the present embodiment, the assistance service is provided for a right turn in the left-hand traffic rule; when a right arrow signal is lighting even though the primary round signal presents a prohibition color (e.g., a red color) which indicates the traffic or passing prohibition state, the condition (3) can be satisfied. The in-vehicle controller 42 executes the determination of the condition (3) and may function as a passing permission determination section, device, or means.

The assistance service area ranges from a predetermined start position located before entering an intersection to a predetermined end position located after turning right at the intersection. The start position of the area may be determined from a coordinate or a distance from the intersection; further, it may be a position where the subject vehicle passes the optical beacon (unshown), or a position where the subject vehicle receives a signal from the road management apparatus 30. When the start position is determined bases on the distance from the intersection, the start position is previously stored in map information and current position information is acquired from a navigation apparatus, thereby determining the start position. The end position of the area may be determined from a coordinate or a distance from the intersection; further, it may be determined based on a distance from the start position. When it is determined that the subject vehicle C passes through the end position of the area, the process S200 of FIG. 8 is ended.

When starting the process S200, the in-vehicle apparatus 40 determines first whether the obstacle existence or nonexistence information in the area B is received at S201. The obstacle existence or nonexistence information transmitted from the road management apparatus 30 includes the obstacle existence or nonexistence information with respect to each crosswalk around the intersection. Thus, the obstacle existence or nonexistence information item that is used for the determination at S201 is determined from all the obstacle existence or nonexistence information items transmitted from the road management apparatus 30. Such determination is made using a road ID of the road which the subject vehicle C is running, and the road ID attached to the obstacle existence or nonexistence information. The road ID of the road which the subject vehicle C is running is obtained from an optical beacon when passing the optical beacon provided before entering the intersection. The road ID changes in a clockwise rotation order or a counterclockwise rotation order under the fixed rule as mentioned above. Therefore, if the road ID which the subject vehicle C is running is known, the road ID after turning right at the intersection can be determined. For instance, an intersection may be formed by four roads assigned clockwise with IDs of 1, 2, 3, 4. Thus, if a first road ID of a first road which the subject vehicle is running is "3", a second road ID after turning right at the intersection is a numerical value smaller than the first road ID by one, i.e., "2." Thus, after determining the obstacle existence or nonexistence information item used for the determination at S201, the determination at S201 is executed based on that determined obstacle existence or nonexistence information item. In addition, the determination at S203 is also performed using the same information item.

When it is determined that the obstacle existence or nonexistence information in the area B is received (S201: Yes), the in-vehicle apparatus 40 outputs a notice sound speech, such as "a pedestrian is existing" via the speaker 43, and displays a notice image indicated in FIG. 6A on a display region of the display 44, at S202. In contrast, when it is not determined that the obstacle existence or nonexistence information in the area B is received (S201: No), the road management apparatus 30 executes a determination at S203.

The in-vehicle apparatus 40 determines whether the obstacle existence or nonexistence information in the area A+area B is received at S203. When it is determined that the obstacle existence or nonexistence information in the area A+area B is received (S203: Yes), the in-vehicle apparatus 40 outputs a notice sound speech, such as "pay attention to a pedestrian" via the speaker 43, and displays a notice image indicated in FIG. 6B on a display region of the display 44, at S204.

When S202 or S204 is finished, or when it is not determined that the obstacle existence or nonexistence information in the area A+area B is received (S203: No), the in-vehicle apparatus 40 returns to S201.

In the above explained first embodiment, when the currently indicating signal color of the pedestrian-use traffic signal 20 corresponding to the crosswalk Z through which the subject vehicle C passes after the right-turn is green, an obstacle which exists in area A+area B is reported. In contrast, when the currently indicating signal color of the pedestrian-use traffic signal 20 is red and the red light elapsed time t1 is greater than $\alpha$ and less than T1−$\beta$ ($\alpha$<t1<T1−$\beta$), only the obstacle which exists in the area B is reported. Thus, based on the currently indicating signal color of the pedestrian-use traffic signal 20, the reported area where the obstacle exists changes. The existence of the obstacle having a low report necessity can be thus suppressed from being reported.

Further, in the above first embodiment, even if the pedestrian-use traffic signal 20 switches from the green lighting state into the red lighting state, only the area B is not designated immediately as an area where an existence of an obstacle is reported. Instead, only while the first marginal time $\alpha$ after changing into the red lighting state, an obstacle existing in an area covering both the area A and area B is reported. Thereafter, only the obstacle which exists in the area B is reported. There may be existing a pedestrian enters the crosswalk in violation of a traffic regulation just immediately after the currently indicating signal color of the pedestrian-use traffic signal 20 changes from the green color to the red color. According to the present first embodiment, the driver can recognize the existence of the pedestrian who may enter the crosswalk Z against the traffic regulation by virtue of the report or notification.

Further, in the above first embodiment, the report of an obstacle existing in the area A and area B is not made just after the pedestrian-use traffic signal 20 switches from the red lighting state into the green lighting state. Alternatively, the report of the existence of the obstacle in the area A or area B can be made in advance by the second marginal time $\beta$. Therefore, the driver can recognize the existence of a pedestrian who may start the entrance into the crosswalk Z by force even before the currently indicating signal color of the pedestrian-use traffic signal 20 becomes green.

Modification of First Embodiment

In the above first embodiment, the in-vehicle apparatus 40 differentiate the content of the report between the case where the obstacle existence or nonexistence information in the area B is received (S201: Yes) and the case where the obstacle existence or nonexistence information in the area A+the area B is received (S203: Yes). Without need to be limited thereto, the contents of the report may be identical between the above two cases. For instance, the report may be made "a pedestrian is existing". In this case, two determination steps at S201, S203 in FIG. 8 may be replaced with one determination to determine whether obstacle existence or nonexistence information is received. Thereby, this determination is made affirmatively, a predetermined report may be made.

In this case, the same report is made regardless of where the obstacle is existing. The driver cannot determine, from the same report, whether the reported obstacle needs to be paid attention seriously or not. There may be existing an obstacle having low necessity for the report based on the currently indicating signal color. In such a case, the report can be reduced; thereby, the troublesomeness of the driver can be reduced accordingly.

Second Embodiment

Figure 9:
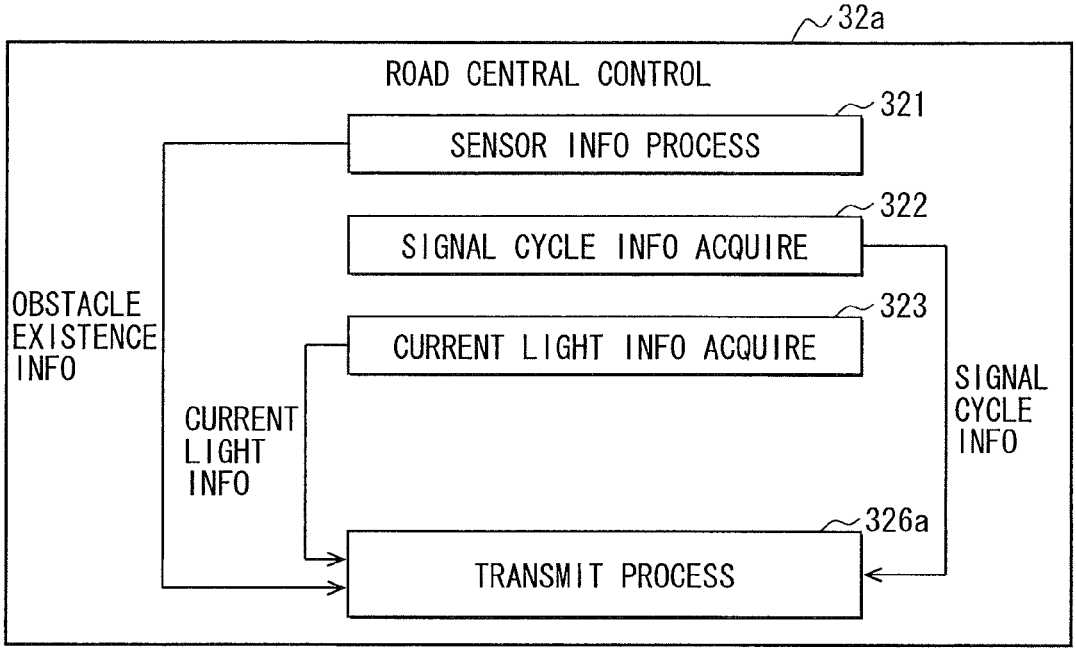
FIG. 9 is a block diagram illustrating a configuration of a road central controller in an obstacle report system according to a second embodiment of the present invention.
Figure 10:
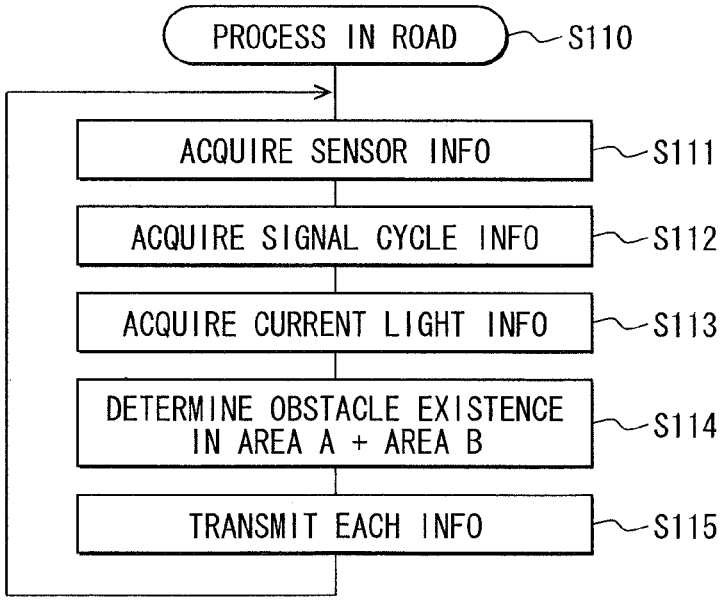
FIG. 10 is a flowchart diagram illustrating an example of a process executed by a road management apparatus according to the second embodiment.
Figure 11:
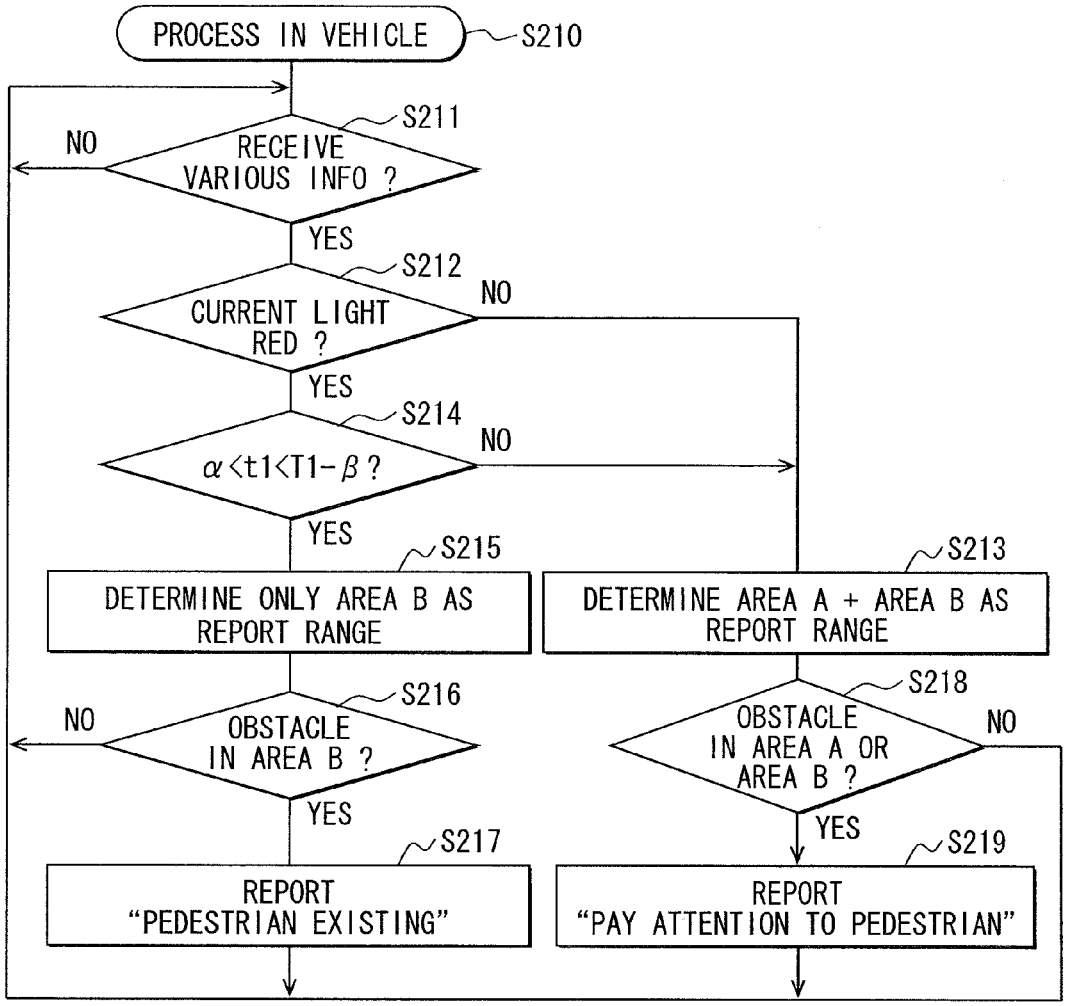
FIG. 11 is a flowchart diagram illustrating an example of a process executed by an in-vehicle apparatus according to the second embodiment.

The following will explain an obstacle detection apparatus and an in-vehicle apparatus according to a second embodiment of the present invention with reference to FIG. 9 to FIG. 11. In the first embodiment of the present invention, the obstacle transmission area is determined by the road management apparatus 30. Thereby, the existence area of the obstacle reported from in-vehicle apparatus 40 is determined. The second embodiment of the present invention is different from the first embodiment in that the road management apparatus 30 does not determine any obstacle transmission area, whereas the in-vehicle apparatus 40 determines the existence area of the obstacle that is to be reported.

Figure 3:
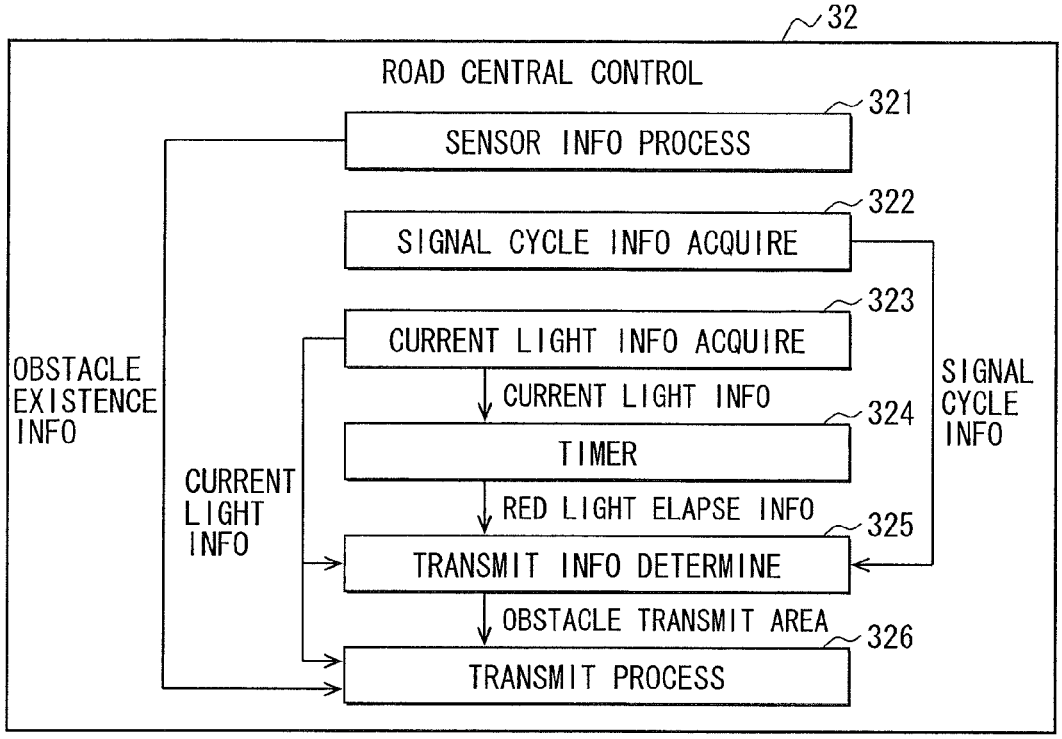
FIG. 3 is a block diagram illustrating a configuration of a road central controller included in the road management apparatus according to the first embodiment.

In detail, as indicated in FIG. 9 corresponding to FIG. 3, the road central controller 32*a* includes a sensor information processing section 321, a signal cycle information acquisition section 322, a currently indicating signal color information acquisition section 323, and a transmission processing section 326*a*. It is noted that the sensor information processing section 321, the signal cycle information acquisition section 322, and the currently indicating signal color information acquisition section 323 are identical to those of the first embodiment; thus, the overlapped explanation is omitted.

The remaining transmission processing section 326*a* transmits (i) obstacle existence or nonexistence information outputted from the sensor information processing section 321, (ii) signal cycle information outputted from the signal cycle information acquisition section 322, and (iii) currently indicating signal color information outputted from the currently indicating signal color information acquisition section 323, from the road communicator 31 to the in-vehicle apparatus 40.

FIG. 10 is a flowchart illustrating a process S110 executed by the road management apparatus 30 according to the second embodiment. After starting the process S110 indicated in FIG. 10, the road management apparatus 30 acquires sensor information from the road detection sensor 10 provided to correspond to each crosswalk which exists in the intersection, at S111. Next, as S112, S113, the road management apparatus 30 acquires the signal cycle information and currently indicating signal color information from the pedestrian-use traffic signal 20 provided as corresponding to each crosswalk which exists in the intersection. At S114, the obstacle existence or nonexistence information in the area A+area B is determined. The detection area information which indicates the area where the obstacle was detected as mentioned above is included in this obstacle existence or nonexistence information. It is noted that the information is determined based on the sensor information acquired at S111.

The road management apparatus 30 transmits the varieties of information such as the signal cycle information, the currently indicating signal color information, and the obstacle existence or nonexistence information to the in-vehicle apparatus 40 by the wireless communication via the road communicator 31, at S115. This variety of information is the information corresponding to each crosswalk which exists around the intersection. The road management apparatus 30 then returns to S101.

The following explains a process by the in-vehicle apparatus 40 according to the second embodiment with reference to FIG. 11. The execution start condition of FIG. 11 is the same as that of FIG. 8 of the first embodiment. After starting the process S210 indicated in FIG. 11, the in-vehicle apparatus 40 determines whether the various information is received via the in-vehicle communicator 41 at S211. Like in the first embodiment, the information used for the determination is determined from the information transmitted from the road management apparatus 30. Thus, after determining the obstacle existence or nonexistence information item used for the determination at S211, the determination at S211 is executed based on the determined obstacle existence or nonexistence information item. In addition, the other processing in FIG. 11 are also performed using the information determined similarly.

When it is not determined that the variety of information is received (S211: No), the in-vehicle apparatus 40 returns to S211. In contrast, when it is determined that the various information is received (S211: Yes), the in-vehicle apparatus 40 executes a determination at S212.

At S212, the in-vehicle apparatus 40 determines whether the currently indicating signal color is red. When it is determined that the currently indicating signal color is not red (namely, currently indicating signal color green) (S212: No), the in-vehicle apparatus 40 determines both the area A and the area B as a report range at S213, then advancing to a determination at S218.

In addition, when it is determined that the currently indicating signal color is red (S212: Yes), the in-vehicle apparatus 40 executes a determination at S214. At S214, it is determined whether the red light elapsed time t1 is greater than the first marginal time α and less than a time period that is obtained by subtracting the second marginal time β from the red light cycle time T1. When it is not determined that the red light elapsed time t1 is greater than the first marginal time α and less than the time period that is obtained by subtracting the second marginal time β from the red light cycle time T1, i.e., when it is determined that the red light elapsed time t1 is greater than the first marginal time α or greater than the time period that is obtained by subtracting the second marginal time β from the red light cycle time T1 (S214: No), the in-vehicle apparatus 40 determines a report range as covering both the area A and the area B at S213. That is, it is determined that the obstacle which exists in the area A or the area B is reported. The in-vehicle apparatus 40 then executes a determination at S218.

In addition, when it is determined that the red light elapsed time t1 is greater than the first marginal time α and less than the time period that is obtained by subtracting the second marginal time β from the red light cycle time T1 (S214: Yes), the in-vehicle apparatus 40 determines a report range as covering only the area B at S215. That is, it is determined that the obstacle which exists only in the area B is reported. The in-vehicle apparatus 40 then executes a determination at S216.

At S216, the in-vehicle apparatus 40 determines whether an obstacle is detected in the area B based on the obstacle existence or nonexistence information acquired at previous S211. When it is determined that the obstacle is detected in the area B (S216: Yes), the in-vehicle apparatus 40 outputs at S217 a notice sound speech, such as "a pedestrian is existing" via the speaker 43, and displays a notice image indicating a graphic to prompt the driver's attention on the crosswalk on a display region of the display 44, for instance, with reference to FIG. 6A. The in-vehicle apparatus 40 returns to S211. In contrast, when it is not determined that the obstacle is detected in the area B (S216: No), the in-vehicle apparatus 40 returns to S211.

Further, at S218, the in-vehicle apparatus 40 determines whether an obstacle is detected in the area A or the area B based on the obstacle existence or nonexistence information acquired at previous S218. When it is determined that the obstacle is detected in the area A or area B (S218: Yes), the in-vehicle apparatus 40 outputs at S219 a notice sound speech, such as "please pay attention to a pedestrian" via the speaker 43, and displays a notice image indicating a graphic to prompt the driver's attention on the crosswalk and the crosswalk-adjacent area on a display region of the display 44, for instance, with reference to FIG. 6B. The in-vehicle apparatus 40 then returns to S211. In contrast, when it is not determined that the obstacle is detected in the area A or area B (S218: No), the in-vehicle apparatus 40 returns to S211.

According to the second embodiment, like in the first embodiment, the reported area of the existence of an obstacle changes based on the currently indicating signal color of the pedestrian-use traffic signal 20. Thus, the existence of the obstacle having a low report necessity can be suppressed from being reported.

For instance, when the currently indicating signal color of the pedestrian-use traffic signal 20 is red, it is basically determined that the obstacle which exists only in the area B is reported. Thus, the existence of the obstacle having a low report necessity can be suppressed from being reported. In contrast, when the currently indicating signal color of the pedestrian-use traffic signal 20 is green, it is determined that the obstacle which exists in the area A+the area B is reported. The driver can be thus notified of the existence of an obstacle to which the driver needs to pay attention when the currently indicating signal color is green.

Furthermore, even if the pedestrian-use traffic signal 20 switches from the green lighting state into the red lighting state, it is not determined that only the obstacle which exists in the area B is reported immediately. Instead, at least while the first marginal time α after changing into the red lighting state, it is determined that the report is made with respect to the existence of the obstacle which exists in an area covering both the area A and the area B. Therefore, the driver can recognize the existence of the pedestrian who may enter into the crosswalk Z by force by virtue of the report when the currently indicating signal color of the pedestrian-use traffic signal 20 has just changed from green to red.

Further, the report of an obstacle existing in the area A or area B is not determined to be made just after the pedestrian-use traffic signal 20 switches from the red lighting state into the green lighting state. Alternatively, the report of the existence of the obstacle in the area A or area B is determined to be made in advance by the second marginal time β. Therefore, the driver can recognize the existence of a pedestrian who may start the entrance into the crosswalk Z by force even before the currently indicating signal color of the pedestrian-use traffic signal 20 becomes green.

Third Embodiment

Figure 13:
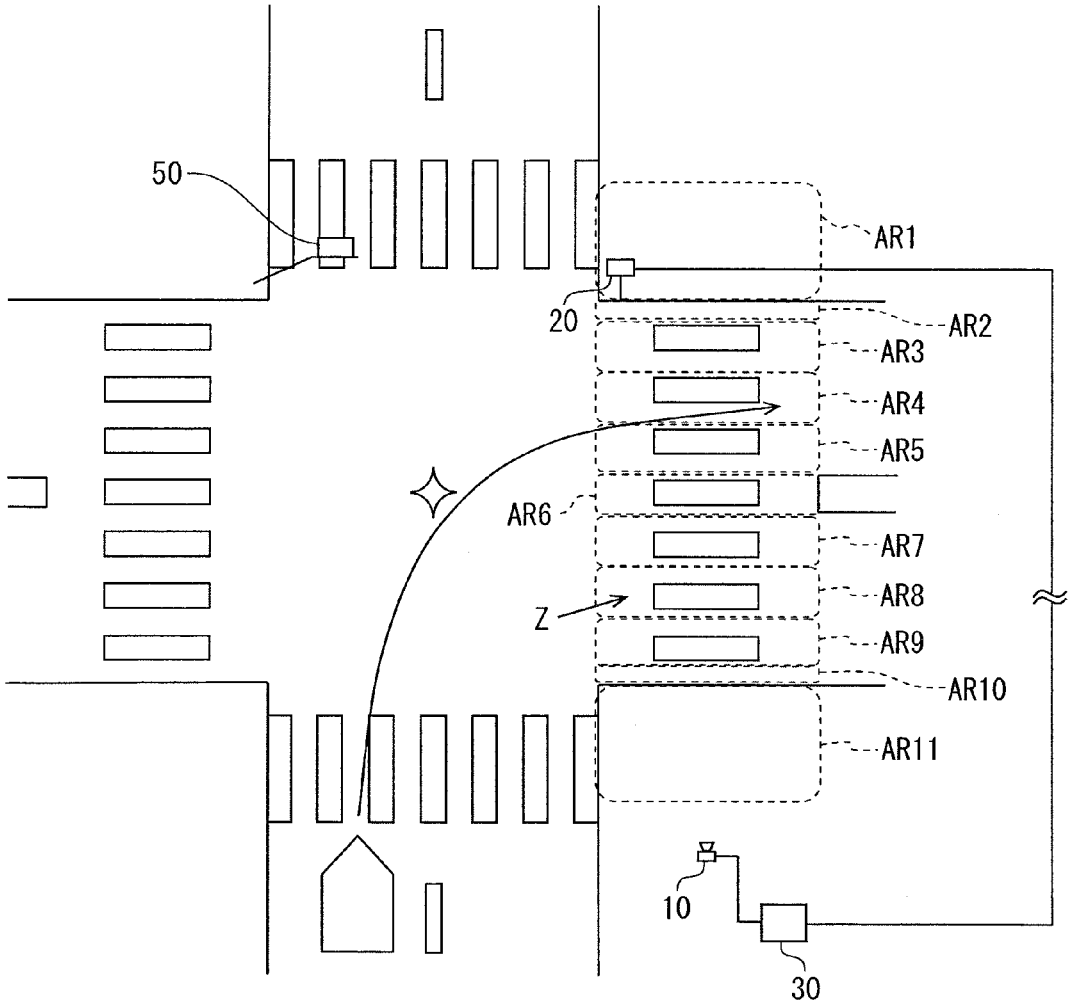
FIG. 13 is a diagram for explaining an existence area of an obstacle that is determined by a road management apparatus according to a third embodiment.
Figure 14:
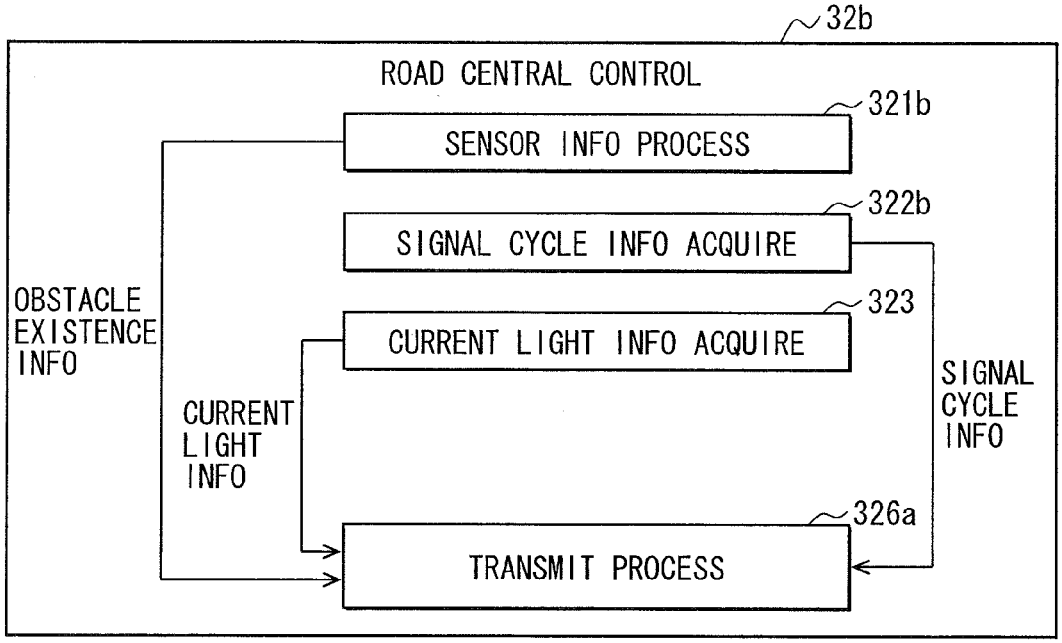
FIG. 14 is a block diagram illustrating a configuration of a road central controller according to the third embodiment.
Figure 15:
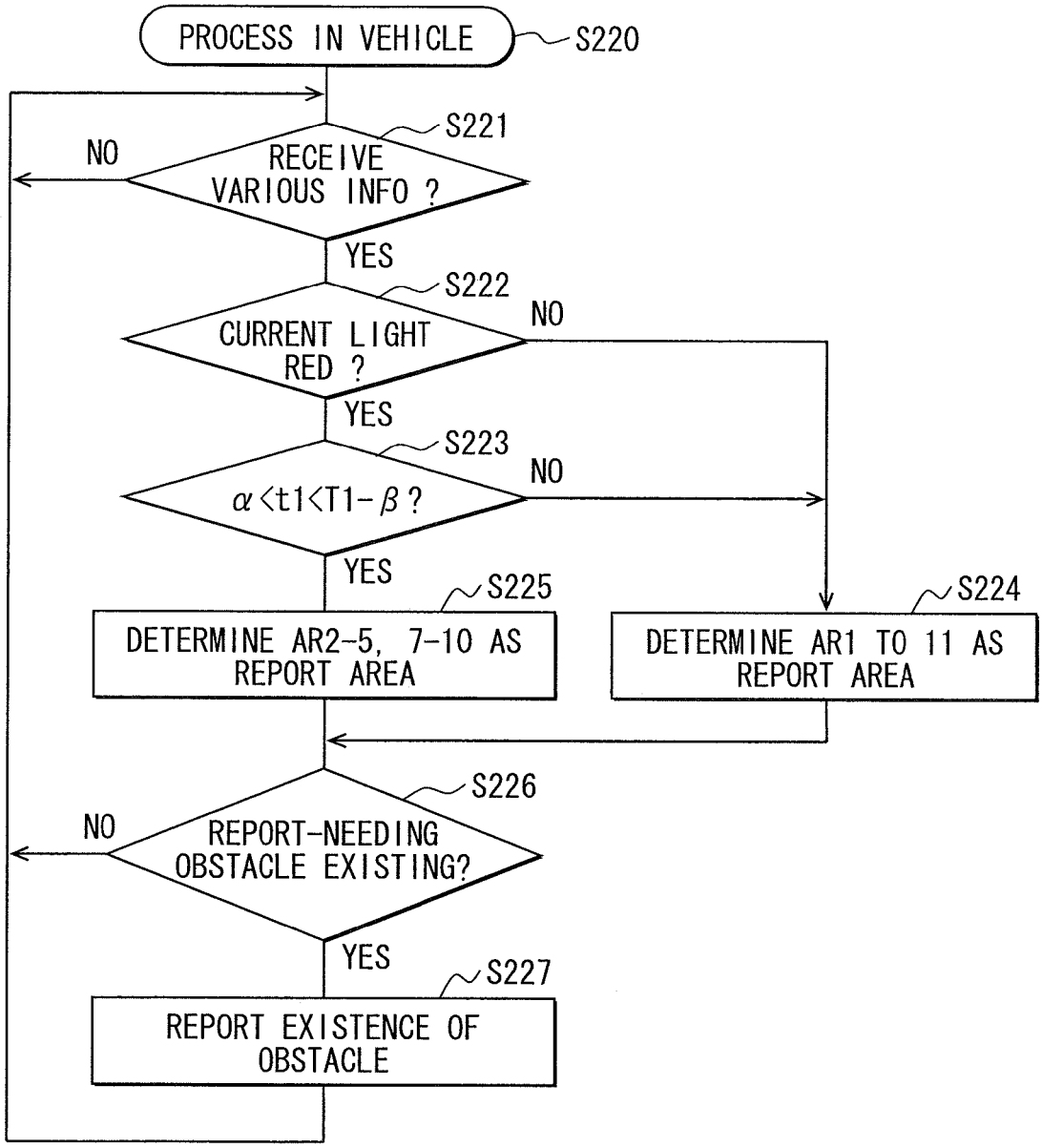
FIG. 15 is a flowchart diagram illustrating a process executed by an in-vehicle apparatus according to the third embodiment.

The following will explain an obstacle detection apparatus and an in-vehicle apparatus according to a third embodiment of the present invention with reference to FIG. 13 to FIG. 15.

In the third embodiment, obstacle's existence areas are finely designated by the road management apparatus 30.

FIG. 13 explains existence areas of obstacles that are determined by the road management apparatus 30 according to the third embodiment. FIG. 13 illustrates several existence areas AR1 to AR11. The area AR1 and the area AR11 are defined as waiting areas for a pedestrian to wait for a signal switching over to a green color before passing through the crosswalk Z; thus, the areas AR1, AR11 correspond to an area A in the previous embodiments.

The areas AR2 and the area AR10 adjacent to the area AR1 and the area AR11, respectively, correspond to roadside areas or roadside belts. The width or the range in the width direction of the area corresponding to the roadside belt (i.e., the longitudinal direction of the crosswalk) is identical to the width or the range in the width direction of the roadside belt. When there is no roadside belt in a road, any area AR2, AR10 are not provided or designated.

The area AR3 is designated to be adjacent to the area AR2, the area AR4 to the area AR3, the area AR5 to the area AR4, respectively, in this order. These areas AR3 to AR5 correspond to traffic lanes of the exit road and are called exit lane corresponding areas.

The area AR6 adjacent to the area AR5 corresponds to a median strip or central divider. The areas AR7 to AR9 correspond to traffic lanes of the entrance road, respectively, and are called entrance lane corresponding areas. It is noted that the number of the areas corresponding to the traffic lanes of the exit road or entrance road changes depending on the number of traffic lanes. Further, there may be no need for the areas to be provided for each traffic lane.

FIG. 14 is a block diagram of the road central controller 32*b* in the third embodiment. This road central controller 32*b* of the third embodiment is different from the road central controller 32*a* of the second embodiment in respect of the sensor information processing section 321*b* and the signal cycle information acquisition section 322*b*. In contrast, the currently indicating signal color information acquisition section 323 and the transmission processing section 326*a* are the same as those of the second embodiment.

The sensor information processing section 321*b* analyzes the sensor information acquired from the road detection sensor 10, thereby determining which area of the areas AR1 to AR11 in FIG. 13 corresponds to a position of an obstacle. The sensor information processing section 321*b* outputs the obstacle existence or nonexistence information to indicate which area corresponds to the existence position of the detected obstacle to the transmission processing section 326*a*.

The signal cycle information acquisition section 322*b* acquires the signal cycle information item outputted from the pedestrian-use traffic signal 20 as well as the signal cycle information item from the vehicle-use traffic signal 50. Both the signal cycle information items are successively outputted to the transmission processing section 326*a*.

The transmission processing section 326*a* transmits, via the road communicator 31, the following: (i) obstacle existence or nonexistence information outputted from the sensor information processing section 321*b*, (ii) signal cycle information outputted from the signal cycle information acquisition section 322, and (iii) currently indicating signal color information outputted from the currently indicating signal color information acquisition section 323.

The following explains a process by the in-vehicle apparatus 40 according to the third embodiment with reference to FIG. 15. The execution start condition of FIG. 15 is the same as that of FIG. 8 of the first embodiment or FIG. 11 of the second embodiment. In the process S220 of FIG. 15 by the in-vehicle apparatus 40, S221, S222 are identical to S211, S212 of FIG. 11, respectively.

When it is determined that the currently indicating signal color of the pedestrian-use traffic signal is red at the determination at S222 (S222: Yes), the in-vehicle apparatus 40 determines whether the red light elapsed time t1 is greater than the first marginal time $\alpha$ and less than the time period that is obtained by subtracting the second marginal time $\beta$ from the red light cycle time T1 at S223. In the third embodiment, the first marginal time $\alpha$ is a time period from when the currently indicating signal color of the pedestrian-use traffic signal 20 changes to red to when the currently indicating signal color of the vehicle-use traffic signal 50 that presents a passing permission of the same direction as that of the pedestrian-use signal 20 changes to red. This first marginal time $\alpha$ is determined using the signal cycle information of the pedestrian-use traffic signal 20. In addition, the first marginal time $\alpha$ may be determined using the currently indicating signal color information of the vehicle-use traffic signal 50, without using the signal cycle information, to be a time period up to the time when the currently indicating signal color of the vehicle-use traffic signal 50 changes to red.

When the determination at S222 is negated (S222: No) or the determination at S223 is negated (S223: No), the areas AR1 to AR11 are determined as a report range or area at S224. Thereby, whether an obstacle exists in the determined report range is determined from the obstacle existence or nonexistence information.

In contrast, when the determination at S223 is affirmed (S223: Yes), the areas AR2 to AR5, AR7 to AR10 are determined as a report range or area at S225. That is, the report range is designated as containing the area corresponding to the exit lanes, the area corresponding to the entrance lanes, and the area corresponding to the roadside belt while excluding the waiting areas and the area corresponding to the median strip. Thereby, whether an obstacle exists in the determined report range is determined from the obstacle existence or nonexistence information.

At S226, it is determined whether an obstacle that is to be reported exists based on a processing result at S224 or S225. When the determination at S226 is negated, the processing returns to S221. In contrast, the determination is made affirmatively, the processing proceeds to S227. At S227, a previously designated process is executed so as to report an existence of an obstacle. This process displays on the display 44 a notice image exemplified in FIG. 6A, for example, and outputs a predetermined notice sound via the speaker 43. This notice sound may be the same as that explained in the above embodiments, or a simple notice sound. After executing S227, the processing returns to S221.

As explained above, according to the present third embodiment, like the crosswalk-adjacent area adjacent to the crosswalk, the areas AR6 corresponding to the median strip with a low possibility of contacting the vehicle is regarded as being similar to the areas AR1, AR11 (waiting areas); thereby, the report is suppressed. Thus, the existence of the obstacle having a low report necessity can be suppressed from being reported.

Further, in the third embodiment, the first marginal time $\alpha$ is defined as being a time period up to the time when the vehicle-use traffic signal 50 having the same direction as that of the pedestrian-use traffic signal 20 changes over to a passing prohibition state. There may be a pedestrian around the crosswalk who enters the crosswalk to pass over the crosswalk until the vehicle-use traffic signal 50 becomes a passing prohibition state even if the pedestrian-use traffic signal 20 changes to a passing prohibition state. According to the present third embodiment, the existence of such a pedestrian or obstacle can be reported.

Modification of Third Embodiment

This modification is an example in the case where a moving speed and a moving direction of each obstacle can be determined. The moving speed and moving direction of each obstacle may be determined by the road management apparatus 30 or the in-vehicle apparatus 40. The moving speed and moving direction of an obstacle is determined by using sensor information, for example. Based on the sensor information, a position of each obstacle is determined successively based on the sensor information. Whether an obstacle at a certain time corresponds to which obstacle out of obstacles defined by the previous sensor information can be determined by a well-known various methods. For example, there is a method of determining a shape of an obstacle and determining an obstacle using a pattern matching. Further, a pedestrian can move a small distance for a short time period. A first obstacle detected at a first time point is determined to be identical to an obstacle closest to the first obstacle among the obstacles detected at a second time point before the first time point. The moving speed and the moving direction of the obstacle may be thereby determined.

Figure 16:
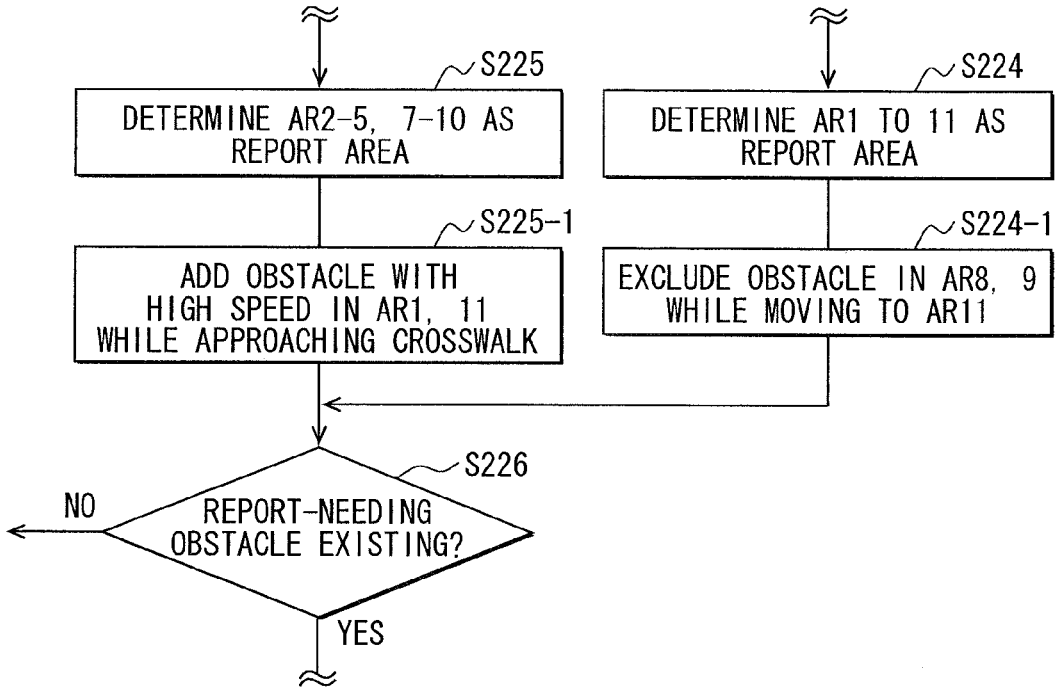
FIG. 16 is a flowchart diagram illustrating a process executed by an in-vehicle apparatus according to a modification of the third embodiment.

FIG. 16 illustrates a process by the in-vehicle apparatus 40 according to this modification. In this modification, S224-1 is executed after S224. Further, S225-1 is executed after S225. Others are the same as those of the third embodiment.

At S224-1, a part of obstacles in the areas AR corresponding to the entrance lanes is excluded from a notice target. That is, suppose an obstacle existing in the area AR8 or the area AR9 close to the area AR11 while advancing towards the area AR1, i.e., approaching the end of the entrance side of the crosswalk. Such an obstacle is excluded from the notice target.

At S225-1, an obstacle is added as a notice target even though existing in a waiting area AR1, AR11 when the following two conditions are satisfied simultaneously: (1) The obstacle is approaching the crosswalk; and (2) The moving speed of the obstacle is greater than a predetermined value. It is noted that the above predetermined speed is around a relatively high speed of a bicycle.

Thus, after exclusion at S224-1 or addition at S225-1, the above-mentioned S226 is determined.

That is, a first obstacle exists in the area AR8 or area AR9 that corresponds to the traffic lane but entrance lane and is closer to the crosswalk-adjacent area among the areas corresponding to the entrance lanes. Furthermore, the first obstacle is moving towards the waiting area AR11 near the entrance lane instead of the exit lane. Such a first obstacle is assumed to be about to finish passing through the crosswalk. Furthermore, when passing over the crosswalk, the subject vehicle passes through the areas AR3 to AR5 corresponding to the exit lanes opposite to the areas AR7 to AR9 corresponding to the entrance lanes. Therefore, this first obstacle may be defined as having a low necessity to report even when the traffic signal presents a passing permission state. To that end, in this modification example, any report is refrained with respect to the first obstacle. Thus, the existence of the obstacle having a low report necessity can be suppressed from being reported.

On the other hand, suppose a second obstacle. The second obstacle still existing in the area AR1 or AR11 in the crosswalk-adjacent area is moving towards the crosswalk with a relatively high speed greater than a predetermined value. Such a second obstacle is defined as being an obstacle whose existence needs to be reported. This enables the report of an existence of an obstacle which passes over the crosswalk by force even though the traffic signal presents a passing prohibition state.

Other Embodiments

Further, the present invention is unlimited to a configuration exemplified in each embodiment, but able to be modified variously within a scope not deviating from the subject matter of the present invention. That is, for example, the above embodiment may be modified suitably as follows.

In the foregoing embodiments, a report is made using both the display and the sound, whereas, any report is not made when the report is refrained or suppressed. However, without need to be limited thereto, a report may be made using only a display without any sound even if the report is refrained. This can suppress the troublesome of the driver because of outputting sounds at least. Furthermore, since the report is made using the display, the driver can recognize an existence of an obstacle from the display.

Further, in the foregoing embodiments, even when the currently indicating signal color of the pedestrian-use traffic light 20 is red, a report is made with respect to an obstacle existing in the area B. However, there is no need of restricting an embodiment to the above. In the foregoing embodiments, it may be determined that an obstacle existing in the area B is not reported either under the state where an obstacle existing in the area B is determined to be reported (the red light elapsed time t1 is greater than $\alpha$ and less than T1−$\beta$ ($\alpha$<t1<T1−$\beta$). In this case, any obstacle existing in the area A+the area B is either reported or not reported eventually. Thus, there is no need to distinguish whether the obstacle exists in the area A, or in the area B.

Further, the report of only an obstacle existing in the area B may be determined to be made just after the pedestrian-use traffic light 20 switches from the green lighting state into the red lighting state. Further, the report of an obstacle existing in the area A or area B may be determined to be made just after the pedestrian-use traffic light 20 switches from the red lighting state into the green lighting state.

Further, in the foregoing embodiments, the area which needs a report of an existence of an obstacle is determined based on a currently indicating signal color of the pedestrian-use traffic light 20. Alternatively, the area which needs a report of an existence of an obstacle may be determined based on the currently indicating signal color of the vehicle-use traffic signal 50, instead of the currently indicating signal color of the pedestrian-use traffic light 20. This configuration can apply to the case where there is not existing a pedestrian-use traffic signal around an intersection.

Figure 17:
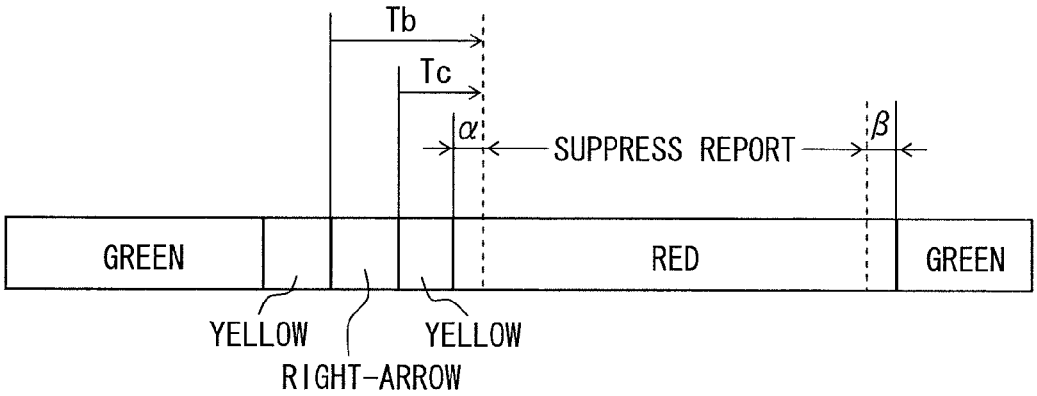
FIG. 17 is a diagram illustrating a time-based relation or sequence of a current light color of a vehicle-use traffic signal and a duration to suppress a report.

FIG. 17 indicates a time-based relation or cycle between the currently indicating signal color of the vehicle-use traffic signal 50 and a period for suppressing a report. As illustrated in FIG. 17, the period for suppressing any report ranges from the time when the above-mentioned first marginal time $\alpha$ elapses since the currently indicating signal color of the vehicle-use traffic signal 50 becomes red to the time when the second marginal time $\beta$ starts. In the foregoing embodiments, the start point of measuring or counting the first marginal time $\alpha$ is defined as being the time point when switching over to the red signal. Instead, another may be adopted as shown in FIG. 17. That is, the lapse of the first marginal time $\alpha$ may be determined by measuring or counting the time Tb starting from the start time of the right-arrow signal or measuring or counting the time Tc starting from the start time of the yellow signal after the right-arrow signal.

In addition, the road detection sensor 10 can use an ultrasonic sensor to detect an obstacle. In addition, the road detection sensor 10 can use a camera as well as an ultrasonic sensor to detect an obstacle.

Further, in the above embodiments, regardless of the currently indicating signal color of the pedestrian-use traffic light 20, the detection area of the obstacle is defined as being the area A+area B. In the first embodiment, the obstacle transmission area is limited when obstacle existence or nonexistence information is transmitted from the road management apparatus 30. In contrast, in the second embodiment, the report range is limited in the in-vehicle apparatus 40. Further, without need to be limited thereto, the road central controller 32 may change the detection range of an obstacle to the "area B" or "the area A or the area B" based on currently indicating signal color.

Figure 12:
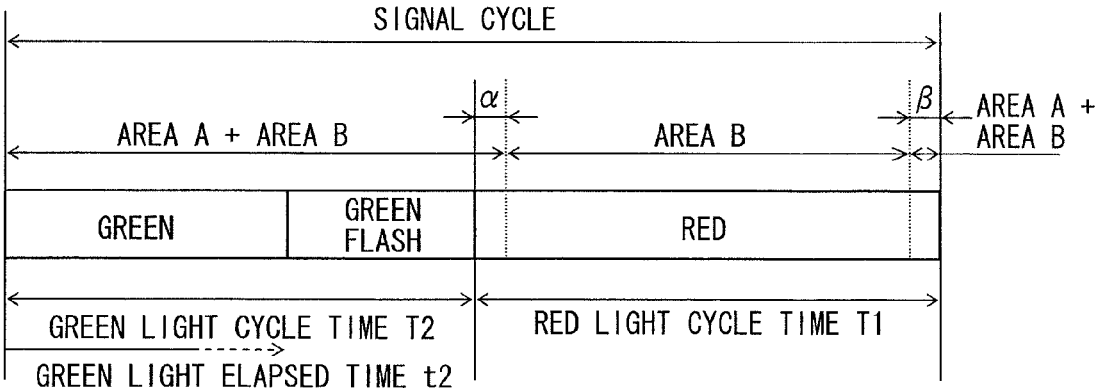
FIG. 12 is a diagram illustrating a time-based relation or sequence of a signal cycle, a report range, a green light cycle time, a red light cycle time, and a green light elapsed time according to another embodiment of the obstacle report system.

Further, in the above embodiments, the report range of an obstacle is determined based on the red light elapsed time t1, which is an elapsed time t1 starting from a base time when the pedestrian-use traffic light 20 switches from the green flashing state (green flash) into the red constant lighting state. However, there is no need of restricting an embodiment to the above. The obstacle transmission area or the report range of an obstacle may be determined based on the green light elapsed time t2, which is an elapsed time starting from a base time when the pedestrian-use traffic light 20 changes from the red constant lighting state into the green constant lighting state, as shown in FIG. 12 corresponding to FIG. 4 of the first embodiment. In specific, the road management apparatus 30 may determine an obstacle transmission area or report range as covering both the area A and area B in two time periods in FIG. 12, based on the signal cycle information acquired by the signal cycle information acquisition section 322 and the green light elapsed time t2 measured by the time section 324. The first time period is from the start of the green light elapsed time t2 up to reach the time which is obtained by adding the first marginal time $\alpha$ to a green light cycle time T2 (also referred to as a green light duration time T2); the second time period is during the second marginal time $\beta$ just before the green light elapsed time t2 reaches the sum of the green light cycle time T2 and the red light cycle time T1.

Further, in the first and second embodiments, the green flashing state is defined as presenting a passing permission state like the green lighting state. The green flashing state may be defined as a passing prohibition state. In addition, in the third embodiment, the area AR2, AR10 corresponding to the roadside belt are defined as being similar to the area corresponding to traffic lanes. However, without need to be limited thereto, the roadside belt is defined as being a vehicle passing prohibition area like a sidewalk; the area corresponding to the roadside belt may be defined as being identical to a waiting area.

Further, in the foregoing embodiments, an existence of the obstacle is reported when the subject vehicle turns right at an intersection in the left-hand traffic rule. However, without need to be limited thereto, an existence of the obstacle may be reported when the subject vehicle turns left at an intersection in the left-hand traffic rule; an existence of the obstacle may be reported when the subject vehicle turns left at an intersection in the right-hand traffic rule; or an existence of the obstacle may be reported when the subject vehicle turns right at an intersection in the right-hand traffic rule.

While examples as aspects of the disclosure described herein are already recited in the preceding summary, further optional aspects thereto may be set out as follows.

For instance, as a second example, the in-vehicle communicator may receive the traffic signal information containing the currently indicating signal color of a pedestrian-use traffic light that corresponds to the crosswalk; and the report processing section may suppress the report of the existence of the obstacle based on the current traffic signal information of the pedestrian-use traffic signal received via the in-vehicle communicator.

For instance, as a third example, the obstacle existence or nonexistence information may distinguish an obstacle in the crosswalk and an obstacle in the crosswalk-adjacent area from each other; and the report processing section may suppress the report of the obstacle in the crosswalk-adjacent area out of the obstacles indicated in the received obstacle existence or nonexistence information based on the received current traffic signal information.

For instance, as a fourth example, the report processing section may suppresses the report with respect to the obstacle in the crosswalk-adjacent area sed on the current traffic signal information that presents a passing prohibition state.

For instance, as a fifth example, the report processing section may execute a report of an obstacle in a designated range covering the crosswalk and the crosswalk-adjacent area when the current traffic signal information presents a passing permission state.

For instance, as a sixth example, the report processing section may execute the report of the obstacle in the designated range covering the crosswalk and the crosswalk-adjacent area until a first marginal time elapses after the current traffic signal information changes from presenting the passing permission state to presenting the passing prohibition state, the first marginal time being shorter than a duration time of the passing prohibition state.

For instance, as a seventh example, the report processing section may execute, even when the current traffic signal information presents the passing prohibition state, the report of the obstacle in the designated range covering the crosswalk and the crosswalk-adjacent area for a second marginal time just before completely elapsing a duration time of the passing prohibition state, the second marginal time being shorter than the duration time of the passing prohibition state.

For instance, as an eighth example, the obstacle existence or nonexistence information may provide a plurality of existence areas each of which is distinctively contained in the crosswalk or the crosswalk-adjacent area; an existence area contained in the crosswalk may include an area corresponding to a median strip; and the report processing section may suppress the report of an obstacle existing in the area corresponding to the median strip in the crosswalk, out of the obstacles indicated in the received obstacle existence or nonexistence information.

For instance, as a ninth example, the obstacle existence or nonexistence information may provide a plurality of existence areas each of which is distinctively contained in the crosswalk or the crosswalk-adjacent area; an existence area contained in the crosswalk may include an area corresponding to an entrance lane that enters the intersection and an area corresponding an exit lane that exits from the intersection; and the report processing section may execute, even when the current traffic signal information presents a passing permission state, a report of an existence of a first predetermined obstacle out of the obstacles indicated in the received obstacle existence or nonexistence information, the first predetermined obstacle existing in a part of areas corresponding to the entrance lanes and moving towards the crosswalk-adjacent area neighboring the areas corresponding to the entrance lanes.

For instance, as a tenth example, the report processing section may execute, even when the current traffic signal information presents a passing prohibition state, a report of an existence of a second predetermined obstacle, which exists in the crosswalk-adjacent area, when the second predetermined obstacle has a moving direction towards the crosswalk and a moving speed greater than a predetermined value.

For instance, as an eleventh example, the report processing section may execute a report of an existence of an obstacle in a designated range covering the crosswalk and the crosswalk-adjacent area when the pedestrian-use traffic signal presents the current traffic signal information indicating a passing permission state; and the report processing section may execute, even after the pedestrian-use traffic signal changes from presenting the passing permission state into presenting the passing prohibition state, a report of an existence of an obstacle in a designated range covering the crosswalk and the crosswalk-adjacent area until a vehicle-use traffic signal having a direction identical to that of the pedestrian-use traffic signal switches over to presenting a passing prohibition state.

For instance, as a twelfth example, the obstacle existence or nonexistence information may provide a plurality of existence areas each of which is distinctively contained in the crosswalk or the crosswalk-adjacent area; existence areas contained in the crosswalk may include an area corresponding to a roadside belt and an area corresponding to a traffic lane; and the report processing section may execute, with respect to the obstacle in the area corresponding to the roadside belt, a process identical to that of a predetermined one of the crosswalk-adjacent area and the area corresponding to the traffic lane, out of the obstacles indicated in the received obstacle existence or nonexistence information, based on the received current traffic signal information.

For instance, as a thirteenth example, the report processing section may execute the report by display and no report by sound, thereby suppressing the report.

For instance, as a fourteenth example, a passing permission determination section may be included to determine whether the vehicle is permitted to pass through the intersection based on a vehicle-use currently indicating color information of a vehicle-use traffic signal in the intersection, the vehicle-use currently indicating signal color information of the vehicle-use traffic signal being received via the in-vehicle communicator. Herein, the report processing section may not execute a report of an existence of an obstacle in the intersection when the vehicle is determined to be not permitted to pass through the intersection.

For instance, as a fifteenth example, the obstacle existence or nonexistence information received via the in-vehicle communicator may provide a plurality of existence areas each of which is distinctively contained in the crosswalk or the crosswalk-adjacent area while indicating which one of the existence areas an obstacle exists; and the report processing section may determine whether an existence area of an obstacle is an area to be reported or not, based on the existence area of the obstacle indicated by the obstacle existence or nonexistence information.

For instance, as a sixteenth example, the report processing section may execute an identical report of an existence of an obstacle regardless of an existence area of the obstacle.

It will be obvious to those skilled in the art that various changes may be made in the above-described embodiments of the present invention. However, the scope of the present invention should be determined by the following claims.

What is claimed:

1. An in-vehicle apparatus in a vehicle communicating with a road management apparatus, the in-vehicle apparatus comprising:

an in-vehicle communicator that receives, from the road management apparatus, (i) obstacle existence or nonexistence information, and (ii) traffic signal information, the obstacle existence or nonexistence information indicating an existence of an obstacle that exists in a designated range containing a crosswalk around an intersection and/or a crosswalk-adjacent area that is adjacent to the crosswalk around the intersection, and further distinguishing an obstacle in the crosswalk and an obstacle in the crosswalk-adjacent area from each other, the traffic signal information containing a currently indicating color of a traffic signal corresponding to the crosswalk; and a report processing section that executes a report with respect to an obstacle around the intersection to a driver of the vehicle, the report processing section being further configured to suppress a report of an existence of an obstacle that is indicated by the obstacle existence or nonexistence information, which is received via the in-vehicle communicator, based on current traffic signal information contained in the traffic signal information received via the in-vehicle communicator, wherein the report processing section suppresses the report of the obstacle in the crosswalk-adjacent area from the obstacles indicated in the received obstacle existence or nonexistence information based on the received current traffic signal information.

2. The in-vehicle apparatus according to claim 1, wherein:

the in-vehicle communicator receives the traffic signal information containing the currently indicating signal color of a pedestrian-use traffic light that corresponds to the crosswalk; and the report processing section suppresses the report of the existence of the obstacle based on the current traffic signal information of the pedestrian-use traffic signal received via the in-vehicle communicator.

3. The in-vehicle apparatus according to claim 2, wherein:

the report processing section executes a report of an existence of an obstacle in a designated range covering the crosswalk and the crosswalk-adjacent area when the pedestrian-use traffic signal presents the current traffic signal information indicating a passing permission state; and the report processing section executes, even after the pedestrian-use traffic signal changes from presenting the passing permission state into presenting the passing prohibition state, a report of an existence of an obstacle in a designated range covering the crosswalk and the crosswalk-adjacent area until a vehicle-use traffic signal having a direction identical to that of the pedestrian-use traffic signal switches over to presenting a passing prohibition state.

4. The in-vehicle apparatus according to claim 1, wherein the report processing section suppresses the report with respect to the obstacle in the crosswalk-adjacent area based on the current traffic signal information that presents a passing prohibition state.

5. The in-vehicle apparatus according to claim 4, wherein the report processing section executes a report of an obstacle in a designated range covering the crosswalk and the crosswalk-adjacent area when the current traffic signal information presents a passing permission state.

6. The in-vehicle apparatus according to claim 5, wherein the report processing section executes the report of the obstacle in the designated range covering the crosswalk and the crosswalk-adjacent area until a first marginal time elapses after the current traffic signal information changes from presenting the passing permission state to presenting the passing prohibition state, the first marginal time being shorter than a duration time of the passing prohibition state.

7. The in-vehicle apparatus according to claim 5, wherein the report processing section executes, even when the current traffic signal information presents the passing prohibition state, the report of the obstacle in the designated range covering the crosswalk and the crosswalk-adjacent area for a second marginal time just before completely elapsing a duration time of the passing prohibition state, the second marginal time being shorter than the duration time of the passing prohibition state.

8. The in-vehicle apparatus according to claim 5, wherein:

the obstacle existence or nonexistence information provides a plurality of existence areas each of which is distinctively contained in the crosswalk or the crosswalk-adjacent area;

an existence area contained in the crosswalk includes an area corresponding to an entrance lane that enters the intersection and an area corresponding an exit lane that exits from the intersection; and the report processing section executes, even when the current traffic signal information presents a passing permission state, a report of an existence of a first predetermined obstacle out of the obstacles indicated in the received obstacle existence or nonexistence information, the first predetermined obstacle existing in a part of areas corresponding to the entrance lanes and moving towards the crosswalk-adjacent area neighboring the areas corresponding to the entrance lanes.

9. The in-vehicle apparatus according to claim 4, wherein the report processing section executes, even when the current traffic signal information presents a passing prohibition state, a report of an existence of a second predetermined obstacle, which exists in the crosswalk-adjacent area, when the second predetermined obstacle has a moving direction towards the crosswalk and a moving speed greater than a predetermined value.

10. The in-vehicle apparatus according to claim 1, wherein:

the obstacle existence or nonexistence information provides a plurality of existence areas each of which is distinctively contained in the crosswalk or the crosswalk-adjacent area;

an existence area contained in the crosswalk includes an area corresponding to a median strip; and the report processing section suppresses the report of an obstacle existing in the area corresponding to the median strip in the crosswalk, out of the obstacles indicated in the received obstacle existence or nonexistence information.

11. The in-vehicle apparatus according to claim 1, wherein:

the obstacle existence or nonexistence information provides a plurality of existence areas each of which is distinctively contained in the crosswalk or the crosswalk-adjacent area;

existence areas contained in the crosswalk include an area corresponding to a roadside belt and an area corresponding to a traffic lane; and the report processing section executes, with respect to the obstacle in the area corresponding to the roadside belt, a process identical to that of a predetermined one of the crosswalk-adjacent area and the area corresponding to the traffic lane, out of the obstacles indicated in the received obstacle existence or nonexistence information, based on the received current traffic signal information.

12. The in-vehicle apparatus according to claim 1, wherein the report processing section executes the report by display and no report by sound, thereby suppressing the report.

13. The in-vehicle apparatus according to claim 1, further comprising:

a passing permission determination section that determines whether the vehicle is permitted to pass through the intersection based on a vehicle-use currently indicating color information of a vehicle-use traffic signal in the intersection, the vehicle-use currently indicating signal color information of the vehicle-use traffic signal being received via the in-vehicle communicator, wherein the report processing section does not execute a report of an existence of an obstacle in the intersection when the vehicle is determined to be not permitted to pass through the intersection.

14. The in-vehicle apparatus according to claim 1, wherein:

the obstacle existence or nonexistence information received via the in-vehicle communicator provides a plurality of existence areas each of which is distinctively contained in the crosswalk or the crosswalk-adjacent area while indicating which one of the existence areas an obstacle exists; and the report processing section determines whether an existence area of an obstacle is an area to be reported or not, based on the existence area of the obstacle indicated by the obstacle existence or nonexistence information.

15. The in-vehicle apparatus according to claim 1, wherein the report processing section executes an identical report of an existence of an obstacle regardless of an existence area of the obstacle.

16. An obstacle report system including a road management apparatus provided for an intersection, and an in-vehicle apparatus mounted in a vehicle to receive information transmitted from the road management apparatus, the road management apparatus comprising:

an obstacle detection section to detect an obstacle in a designated range containing (i) a crosswalk around an intersection, and/or (ii) a crosswalk-adjacent area that is adjacent to the crosswalk around the intersection;

a traffic signal information acquisition section to acquire traffic signal information containing a currently indicating signal color of a traffic signal corresponding to the crosswalk; and a transmission section to transmit (i) obstacle existence or nonexistence information that indicates an existence of an obstacle detected by the obstacle detection section and (ii) traffic signal information acquired by the traffic signal information acquisition section, the in-vehicle apparatus comprising:

an in-vehicle communicator to receive (i) obstacle existence or nonexistence information, which is received from the obstacle detection section via the transmission section of the road management apparatus, and (ii) traffic signal information, which is received from the traffic signal information acquisition section via the transmission section of the road management apparatus; and a report processing section to execute a report of an obstacle indicated in the obstacle existence or nonexistence information, which is received from the obstacle detection section via the in-vehicle communicator, to a driver of the vehicle, the report processing section being further configured to suppress the report of the obstacle based on current traffic signal information contained in the traffic signal information via the in-vehicle communicator, wherein the obstacle existence or nonexistence information distinguishes an obstacle in the crosswalk and an obstacle in the crosswalk-adjacent area from each other, and the report processing section suppresses the report of the obstacle in the crosswalk-adjacent area out of the obstacles indicated in the received obstacle existence or nonexistence information based on the received current traffic signal information.

* * * * *